US009458565B2

(12) United States Patent
Kim et al.

(10) Patent No.: US 9,458,565 B2
(45) Date of Patent: Oct. 4, 2016

(54) LAUNDRY TREATING APPARATUS

(71) Applicant: LG ELECTRONICS INC., Seoul (KR)

(72) Inventors: Kihyuk Kim, Seoul (KR); Sanghun Bae, Seoul (KR); Seunghyun Song, Seoul (KR); Eunyoung Jee, Seoul (KR); Hongjun Cho, Seoul (KR); Seungphyo Ahn, Seoul (KR); Minjung You, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 14/330,492

(22) Filed: Jul. 14, 2014

(65) Prior Publication Data

US 2014/0375189 A1 Dec. 25, 2014

Related U.S. Application Data

(62) Division of application No. 13/334,568, filed on Dec. 22, 2011, now Pat. No. 8,820,861.

(30) Foreign Application Priority Data

Dec. 23, 2010 (KR) ..... 10-2010-0133674
Jun. 2, 2011 (KR) ..... 10-2011-0053385
Dec. 21, 2011 (KR) ..... 10-2011-0139295

(51) Int. Cl.
*A47B 77/06* (2006.01)
*D06F 39/14* (2006.01)
(Continued)

(52) U.S. Cl.
CPC ..... *D06F 39/14* (2013.01); *D06F 37/02* (2013.01); *D06F 37/10* (2013.01); *D06F 37/28* (2013.01); *Y10T 16/540255* (2015.01); *Y10T 16/540257* (2015.01)

(58) Field of Classification Search
CPC ..... A47L 15/4257; A47L 15/4261; D06F 39/14; D06F 37/28; D06F 37/10; D06F 37/02; Y10T 16/540257; Y10T 16/540255
See application file for complete search history.

(56) References Cited

U.S. PATENT DOCUMENTS 872,694 A 12/1907 Thiem
1,053,829 A 2/1913 Keith et al.
(Continued)

FOREIGN PATENT DOCUMENTS

CN 1861893 A 11/2006
CN 101657596 A 2/2010
(Continued)

OTHER PUBLICATIONS

U.S. Notice of Allowance issued in U.S. Appl. No. 13/334,481, dated Aug. 19, 2014.
(Continued)

*Primary Examiner* — Hanh V Tran
(74) *Attorney, Agent, or Firm* — Ked & Associates LLP

(57) ABSTRACT

A laundry treating apparatus is provided that includes a cabinet configured that defines a profile of the laundry treating apparatus, the cabinet including a laundry introduction opening formed therein, a door configured to open and close the laundry introduction opening, a hinge unit including a first pivot to rotate the door along a first rotational direction and a second pivot to rotate along a second rotational direction, which is different from the first rotational direction, and a securing member configured to secure the door to the first pivot or the second pivot, when the door is rotated.

18 Claims, 45 Drawing Sheets

(51) Int. Cl.

| | |
|---|---|
| ***D06F 37/02*** | (2006.01) |
| ***D06F 37/10*** | (2006.01) |
| ***D06F 37/28*** | (2006.01) |

(56) References Cited

U.S. PATENT DOCUMENTS

| | | | | | |
|---|---|---|---|---|---|
| 1,496,466 | A | | 6/1924 | Jackson | |
| 2,815,018 | A | | 12/1957 | Collins | 126/190 |
| 2,982,540 | A | * | 5/1961 | Eppley | D06F 37/28 49/277 |
| 3,018,508 | A | | 1/1962 | Keeling, Sr. | 16/147 |
| 3,018,509 | A | | 1/1962 | Sherman | 16/147 |
| 3,030,656 | A | | 4/1962 | Hopkins | 16/147 |
| 3,089,327 | A | | 5/1963 | Stilwell, Jr. | 68/139 |
| 3,520,568 | A | * | 7/1970 | White | D06F 37/28 292/255 |
| 3,538,641 | A | | 11/1970 | Miller et al. | 49/192 |
| 3,603,631 | A | * | 9/1971 | White | D06F 37/28 292/220 |
| 3,690,035 | A | | 9/1972 | Schindlauer et al. | 49/192 |
| 3,802,124 | A | | 4/1974 | Guerrini | 49/192 |
| 4,035,953 | A | | 7/1977 | Bierlich | 49/192 |
| 4,096,602 | A | | 6/1978 | Nelson | 16/85 |
| 4,503,582 | A | | 3/1985 | Gurubatham | 16/232 |
| 4,532,673 | A | | 8/1985 | Kim | 16/233 |
| 4,665,892 | A | | 5/1987 | Spargo et al. | 126/194 |
| 5,127,169 | A | * | 7/1992 | Ellingson | D06F 58/04 34/601 |
| 5,253,433 | A | * | 10/1993 | Frey | D06F 58/04 16/235 |
| 5,530,992 | A | | 7/1996 | Baermann | 16/231 |
| 5,570,597 | A | * | 11/1996 | Bongini | D06F 37/22 68/139 |
| 5,829,197 | A | | 11/1998 | Oh | 49/193 |
| 5,911,264 | A | | 6/1999 | Smrke et al. | 16/258 |
| 6,000,769 | A | | 12/1999 | Chen | 312/223.2 |
| 6,679,572 | B2 | * | 1/2004 | Sears | D06F 39/14 312/319.2 |
| 6,954,992 | B2 | * | 10/2005 | Hwang | D06F 58/04 34/108 |
| 7,243,973 | B2 | | 7/2007 | Plett et al. | 296/57.1 |
| 7,481,479 | B1 | | 1/2009 | Townson et al. | 296/51 |
| 7,516,515 | B2 | | 4/2009 | Leimkuehler et al. | 16/231 |
| 7,547,056 | B2 | | 6/2009 | Waldner et al. | 296/57.1 |
| 7,669,908 | B2 | | 3/2010 | Townson | 296/51 |
| 7,740,157 | B2 | | 6/2010 | Fisher et al. | 224/328 |
| 8,820,861 | B2 | | 9/2014 | Kim et al. | |
| 2003/0084590 | A1 | | 5/2003 | Tomasi et al. | |
| 2005/0056059 | A1 | * | 3/2005 | Usherovich | D06F 39/14 68/12.02 |
| 2006/0086155 | A1 | | 4/2006 | Kim et al. | |
| 2007/0151300 | A1 | | 7/2007 | Sunshine | |
| 2008/0172838 | A1 | | 7/2008 | Choi | 16/366 |
| 2008/0245112 | A1 | | 10/2008 | Sung | 68/12.26 |
| 2009/0025178 | A1 | | 1/2009 | Tamayama et al. | 16/221 |
| 2009/0229316 | A1 | | 9/2009 | Yoo et al. | 68/13 R |
| 2010/0175221 | A1 | | 7/2010 | Klassen et al. | 16/229 |
| 2010/0212112 | A1 | | 8/2010 | Steurer et al. | 16/286 |
| 2012/0161594 | A1 | | 6/2012 | Kim et al. | 312/228 |

FOREIGN PATENT DOCUMENTS

| | | | |
|---|---|---|---|
| DE | 10 2007 017 916 | B3 | 6/2008 |
| DE | 10 2007 012 980 | A1 | 9/2008 |
| EP | 1 652 992 | A2 | 5/2006 |
| JP | S48-074044 | | 10/1973 |
| JP | S50-032545 | | 3/1975 |
| JP | S60-080280 | | 6/1985 |
| JP | 7-289774 | | 11/1995 |
| JP | 08-164294 | | 6/1996 |
| JP | 09-136576 | | 5/1997 |
| JP | 09-182709 | | 7/1997 |
| JP | 2000-279697 | | 10/2000 |
| JP | 2001-057955 | | 3/2001 |
| JP | 2006-314561 | | 11/2006 |
| KR | 10-2007-0038720 | A | 4/2007 |
| KR | 10-2009-0096948 | A | 9/2009 |
| WO | WO 2008/052984 | A1 | 5/2008 |
| WO | WO 2009/116752 | A2 | 9/2009 |

OTHER PUBLICATIONS

Australian Office Action issued in Application No. 2011345515 dated Mar. 17, 2015.

U.S. Appl. No. 13/334,481, filed Dec. 22, 2011, Andrew Mark Roersma.

U.S. Appl. No. 13/334,568, filed Dec. 22, 2011, Kim et al.

International Search Report and Written Opinion dated Aug. 9, 2012 issued in Application No. PCT/KR2011/010017.

International Search Report and Written Opinion dated Aug. 9, 2012 issued in Application No. PCT/KR2011/010021.

U.S. Office Action issued in U.S. Appl. No. 13/334,481 dated Aug. 16, 2013.

U.S. Office Action issued in U.S. Appl. No. 13/334,568 dated Oct. 22, 2013.

U.S. Office Action issued in U.S. Appl. No. 13/334,481 dated Mar. 13, 2014.

U.S. Notice of Allowance issued in U.S. Appl. No. 13/334,568 dated Apr. 30, 2014.

* cited by examiner (a)

(b)

(a)

(b)

(a)

(b)

(a)

(b)

(a)

(b)

LAUNDRY TREATING APPARATUS

CROSS-REFERENCE TO RELATED APPLICATION

This is a divisional application of U.S. patent application Ser. No. 13/334,568 filed on Dec. 22, 2011, which claims the benefit of Korean Patent Application Nos. 10-2010-0133674, filed on Dec. 23, 2010; 10-2011-0053385 filed on Jun. 2, 2011 and 10-2011-0139295 filed on Dec. 21, 2011 which were hereby incorporated by reference as if fully set forth herein.

BACKGROUND

1. Field

Embodiments may relate to a laundry treating apparatus, more particularly, to a laundry treating apparatus which includes a door rotated along various directions to be open to open and close a laundry introduction opening.

2. Background

Generally, a laundry treating apparatus may be categorized into a washing-only apparatus only having a washing function, a drying-only apparatus only having a drying function and a laundry washing/drying apparatus having both of the washing and drying functions. Also, based on a structure and a type, the laundry treating apparatuses may be categorized into a drum type laundry treating apparatus which dries laundry while tumbling the laundry by using a rotatable drum and a cabinet type laundry treating apparatus which dries laundry while hanging the laundry therein.

In a conventional washing/drying apparatus, a laundry introduction opening is formed in a front of a cabinet to introduce laundry there through. Also, a door may be installed to the front of the cabinet to open and close the laundry introduction opening. Here, the door includes a single shaft capable of rotating along a right and left direction to open and close the opening.

In the meanwhile, the laundry treating apparatus that is the drying-only apparatus may be arranged next to a lateral side of the washing-only apparatus in a line. To dry the laundry washed in the washing-only apparatus, a user may typically unload the washed laundry out of the washing-only apparatus and he or she may load it into the drying-only apparatus via the laundry introduction opening.

A door provided in the conventional laundry treating apparatus including the conventional washing machine having the drying function and the dryer may be rotated along a horizontal direction from an opening to open and close the opening. Because of that, when the laundry is introduced into the accommodating room via the opening, the laundry happens to fall on the floor near the opening disadvantageously.

If the laundry falls on the floor, foreign substances located on the floor might be attached to the laundry and the laundry might get more dust. The user has to pick up the laundry to place it into the opening inconveniently.

In the meanwhile, when the laundry treating apparatus is rotated only along a horizontal direction to be open, there might be spatial limitation of installing the cabinet of the laundry treating apparatus distant from a wall to get the space to rotate the door.

SUMMARY

Accordingly, the embodiments may be directed to a laundry treating apparatus. To achieve these objects and other advantages and in accordance with the purpose of the embodiments, as embodied and broadly described herein, a laundry treating apparatus includes a cabinet configured to define a profile thereof, the cabinet comprising a laundry introduction opening formed therein; a door configured to open and close the laundry introduction opening; a hinge unit comprising a first pivot to rotate the door along a first rotational direction and a second pivot to rotate a second rotational direction that is different from the first rotational direction; and a securing member configured to secure the door to the first pivot or the second pivot, when the door is rotated.

The hinge unit may further include a first hinge including a first shaft forming the first pivot and a first shaft detaching part having a first receiving groove formed thereon.

The securing member may include a first bar configured to open and close the first receiving groove.

The hinge unit may further include a third hinge including a fourth shaft forming the second pivot and a fourth detaching part having a second receiving groove formed therein to detach the fourth shaft there from.

The securing member may include a second bar configured to open and close the second receiving groove.

A guide groove may be provided in the fourth shaft detaching part to guide an end of the second bar to be rotatable.

A stopper may be formed in the second receiving groove to stop the rotation of the fourth shaft.

A sectional area of the fourth shaft may include a first flat surface and the stopper may include a second flat surface corresponding to the first flat surface.

In another aspect, a laundry treating apparatus includes a cabinet configured to define a profile thereof, the cabinet comprising a laundry introduction opening formed therein; a door configured to open and close the laundry introduction opening; and a hinge unit comprising a first pivot to rotate the door along a first rotational direction and a second pivot to rotate a second rotational direction that is different from the first rotational direction; a securing member configured to secure the door to the first pivot or the second pivot, when the door is rotated; and a pressing piece configured to move the securing member.

The laundry treating apparatus may further include a safety bar configured to limit the motion of the pressing piece.

A through hole may be formed in the pressing piece to insert the safety bar therein in a state of the pressing piece pressed.

A seating protrusion may be formed in the pressing piece to seat the safety bar thereon in the state of the pressing piece not pressed to limit the motion of the pressing piece.

A projected piece may be formed in the safety bar and the safety bar may further include a first pin configured to press the projected piece to move the safety bar and a second pin configured to press the first pin.

The first pin may be installed in the door and the second pin is installed in the cabinet.

The first pin may be embedded not to be exposed outside the door.

In a further aspect, a laundry treating apparatus includes a cabinet configured to define a profile thereof, the cabinet comprising a laundry introduction opening formed therein; a door configured to open and close the laundry introduction opening; and a hinge unit comprising a first pivot to rotate the door along a first rotational direction and a second pivot to rotate a second rotational direction that is different from the first rotational direction, wherein an inclined piece inclined a predetermined angle is formed at a lower end of the door.

The inclined piece may contact with the cabinet and the rotation of the door stops when the door is rotated a predetermined angle along the second rotational direction.

The laundry treating apparatus may further include a damper part configured to damp a shock generated when the inclined piece contacts with the cabinet.

The plurality of the damper parts may be arranged in the inclined piece or the cabinet.

A spring washer may be installed in the second pivot.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

To solve the disadvantages mentioned above, embodiments may provide a laundry treating apparatus including a laundry introduction opening, which can provide convenience to the user by enabling a door open and closed along a vertical or horizontal direction selectively.

Furthermore, the embodiments may provide a laundry treating apparatus which can open the door stably, because the door is not open along the other rotational direction, when the user rotates the door along a selected rotational direction.

Still further, the embodiments may provide a laundry treating apparatus which can reduce installation spatial limitation of securing a space for opening the door, when the laundry treating apparatus is used.

Still further, the embodiments may provide a laundry treating apparatus which enables laundry to be loaded into an accommodating room via the opening smoothly after colliding against a surface of the door, when laundry is loaded via the opening.

As follows, exemplary embodiments will be described in detail in reference to the accompanying drawings. Reference may now be made in detail to specific embodiments, examples of which may be illustrated in the accompanying drawings. Wherever possible, same reference numbers may be used throughout the drawings to refer to the same or like parts.

Figure 1:
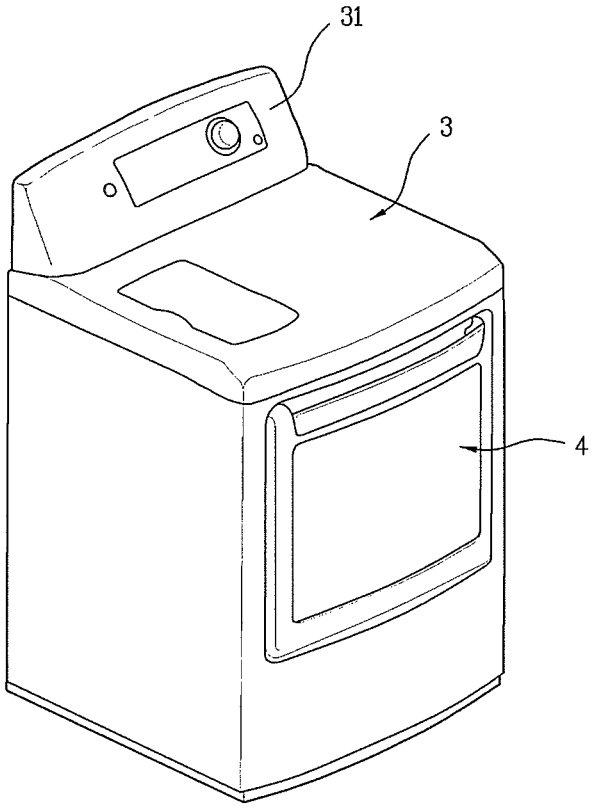
FIG. 1 is a perspective view illustrating a laundry treating apparatus according to an exemplary embodiment.
Figure 2:
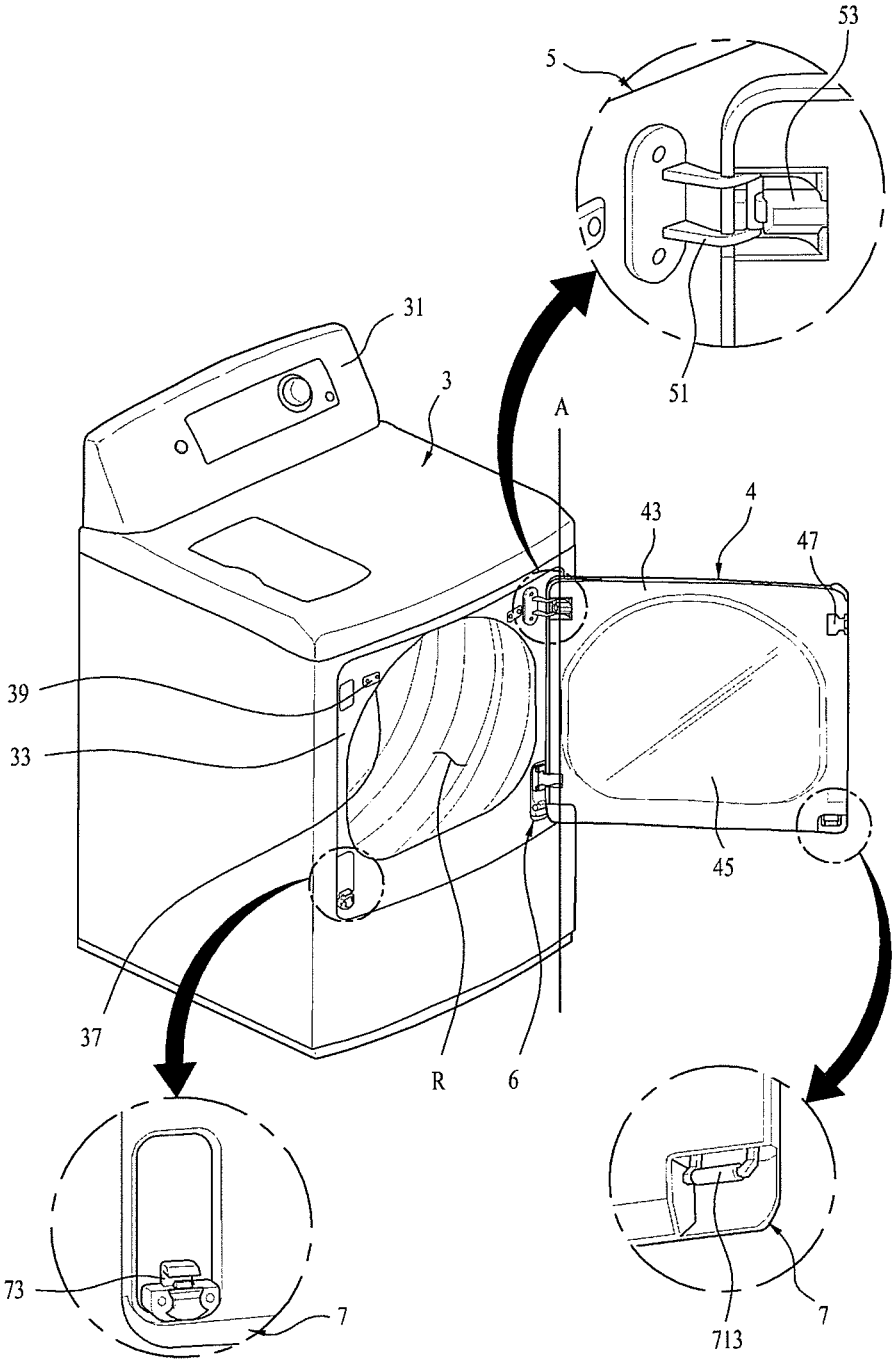
FIG. 2 is a diagram illustrating a door shown in FIG. 1 which is rotated along a first rotational direction.
Figure 3:
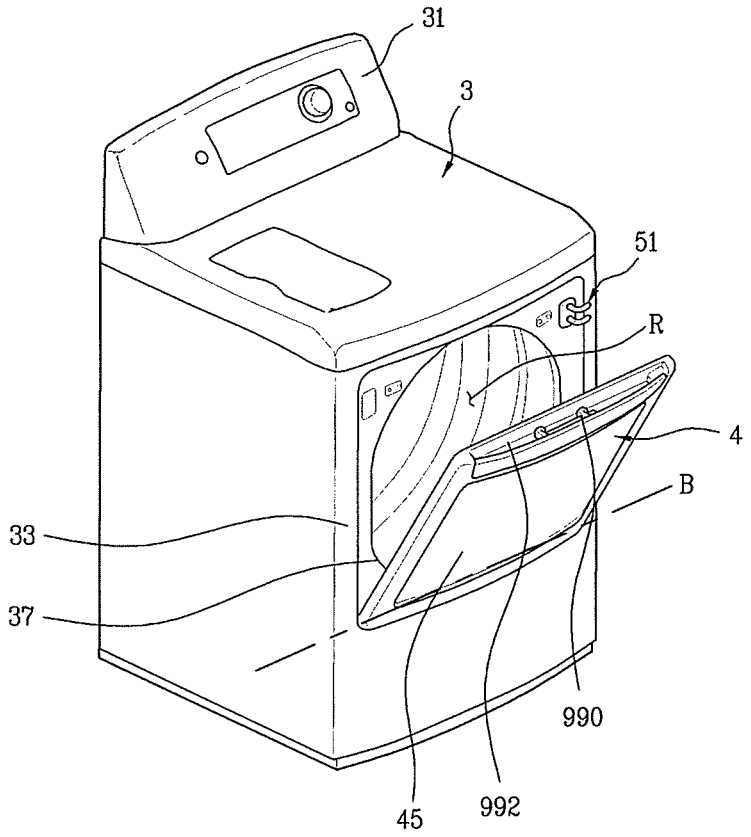
FIG. 3 is a diagram illustrating the door shown in FIG. 1 which is rotated along a second rotational direction.

FIG. 1 is a perspective view illustrating a laundry treating apparatus according to an exemplary embodiment. FIG. 2 is a diagram illustrating a door shown in FIG. 1 which is rotated along a first rotational direction. FIG. 3 is a diagram illustrating the door shown in FIG. 1 which is rotated along a second rotational direction. As follows, the laundry treating apparatus according to the embodiment will be described in reference to FIGS. 1 to 3.

The laundry treating apparatus according to the embodiment may include a cabinet 3 having a laundry accommodating room (R) and a laundry introduction opening 37 enabling laundry loaded into the laundry accommodating room, a door 4 provided to open and close the opening 37, and a hinge unit 5, 6, and 7 configured to rotate the door 4 to open and close the opening, along different directions.

The cabinet 3 may define a profile of the laundry treating apparatus and the laundry introduction opening 37 may be provided through an outer panel 33 provided in a side of the cabinet to communicate with the laundry accommodating room (R).

A locking projection receiving part 39 may be provided in the outer panel 33 to receive a locking projection 47 provided in the door 4. The locking projection 47 of the door 4 may be received in the locking projection receiving part 39 provided in the cabinet, such that the door 4 may open and close the laundry introduction opening.

In the meanwhile, a control panel 31 may be provided on the cabinet 3 to enable a user to input a control command to the laundry treating apparatus.

The hinge unit 5, 6 and 7 may form a first pivot (A) to rotate the door to open and close the opening 37 and a second pivot (B) to rotate the door 4 to open and close the opening 37 along a different direction from a direction of the first pivot (A). The first pivot (A) may be vertical to the cabinet 3 and the second pivot (B) may be horizontal to the cabinet 3.

The first pivot may be formed by a first hinge 5 and a second hinge 6. The second pivot may be formed by the second hinge 6 and a third hinge 7.

In FIGS. 2 and 3, the first pivot (A) may be formed along a longitudinal direction of the cabinet 3 (A vertical pivot) and the second pivot (B) may be formed along a width direction of the cabinet (A horizontal pivot). However, the location of the first pivot and the location of the second pivot may not be limited to what shown in FIG. 2 necessarily.

In other words, the first pivot and the second pivot may be located at various positions of the cabinet only if they enable the door to be rotated along various directions to open the opening (only if the first pivot and the second pivot form a preset angle). Here, the direction of the first pivot (the first direction) may be different from the direction of the second pivot (the second direction).

Here, as shown in FIG. 3, the second pivot may be provided along the width direction of the cabinet to enable the door to be tilted with respect to a lower end of the opening 37. In this case, there may be an effect of efficient laundry loading caused by adjusting a tilting angle of the door, which will be described later.

The hinge unit may include the first hinge 5 having a first shaft consisting of the first pivot (A) to couple and detach the door to and from the cabinet 3, the second hinge 6 having a second shaft consisting of the first pivot (A) together with the first shaft and a third shaft consisting of the second pivot (B), and the third hinge 7 having a fourth shaft consisting of the second pivot (B) together with the third shaft to couple and detach the door 4 to and from the cabinet 3.

The first hinge 5 may include the first shaft 51 forming the first pivot and a first shaft detaching part 53 having a first receiving groove formed therein to receive the first shaft 51. The first shaft 51 may be installed in the cabinet 3 and the first shaft detaching part 53 may be provided in the door 4. Alternatively, the first shaft 51 may be installed in the door 4 and the first shaft detaching part 53 may be installed in the cabinet 3.

The third hinge 7 may include the fourth shaft 713 to form the second pivot (B) and a fourth shaft detaching part 73 having a second receiving groove formed therein to receive the fourth shaft 713. The fourth shaft 713 may be installed in the door 4 and the fourth shaft detaching part 73 may be provided in the cabinet 3. Alternatively, the fourth shaft 713 may be installed in the cabinet 3 and the fourth shaft detaching part 73 may be installed in the door 4.

As shown in FIG. 2, when the door is rotated along a first direction, the first hinge 5 and the second hinge 6 may rotatably couple the door 4 to the cabinet 3. At this time, the third hinge 7 may detach the door 4 from the cabinet 3.

In contrast, as shown in FIG. 3, when the door is rotated along a second direction, the second hinge 6 and the third hinge 7 may rotatably couple the door 4 to the cabinet 3. At this time, the first hinge 5 may detach the door 4 from the cabinet 3.

In other words, when the door 4 is rotated along one of the first and second directions, the second hinge 6 may be secured with respect to both of the directions and the first hinge 5 and the third hinge 7 may couple or detach the door 4 to or from the cabinet 3.

The door 4 may include an inner frame 43 provided toward the outer panel 33 and an outer frame 41 coupled to the inner frame to from a profile of the door 4.

The door may further include a transparent part 45 insertedly provided in the opening 37. The transparent part 45 may prevent the laundry located in the laundry accommodating room (R) from coming out through the laundry introduction opening and it may also allow the user to see the laundry accommodating room (R) during the operation of the laundry treating apparatus.

As shown in FIG. 3, a recessed part 992 recessed a preset distance along a longitudinal direction may be provided at an upper end of the door 4. The recessed part 992 may be longitudinally extended along a width direction of the door 4 and it may be extended as long as the horizontal length of the door 4.

A pressing piece 990 that is able to be grasped by the user may be provided at a center of the recessed part 992. The pressing piece 990 may be installed at the center of the door 4 to allow the user to press the door 4 when rotating it along the second rotational direction. When the user is pressing the pressing piece 990, the door 4 may be stably rotated along the rotational direction the user selects by a variety of elements installed in the door 4 which will be described later.

In the meanwhile, the user may grasp the recessed part 992 to rotate the door 4, without grasping the pressing piece 990 located at the center of the recessed part 992. When trying to rotate the door 4 along the first rotational direction, not the second rotational direction, the user may grasp not the pressing piece 990 but other portions of the recessed part 992 where the pressing piece 990 is not located, to rotate the door 4. For example, when trying to rotate the door along the first rotational direction, the user may grasp a portion located in opposite to the first pivot (A) of the first rotational direction and he or she may open the door 4 after that.

Figure 4:
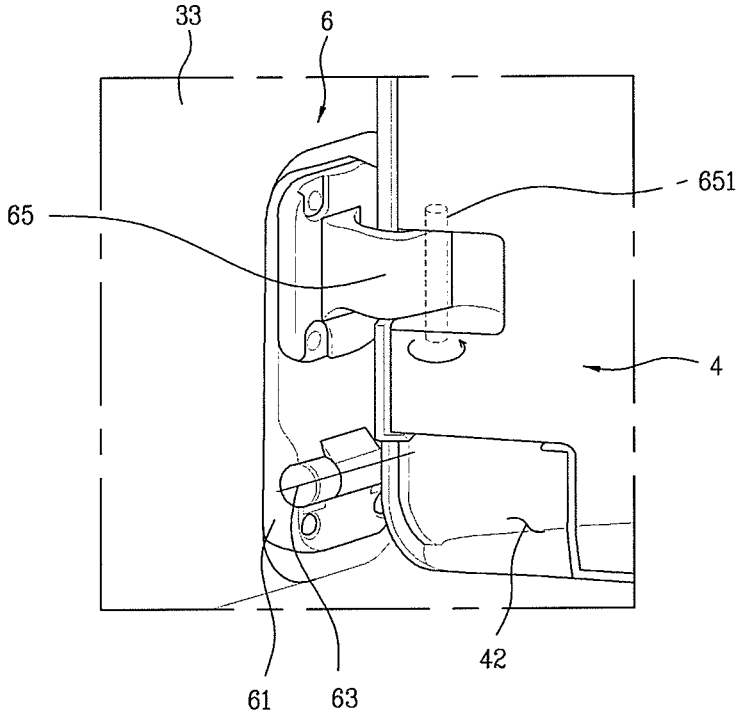
FIG. 4 is a diagram illustrating a second hinge which is rotated along a first rotational direction.
Figure 5:
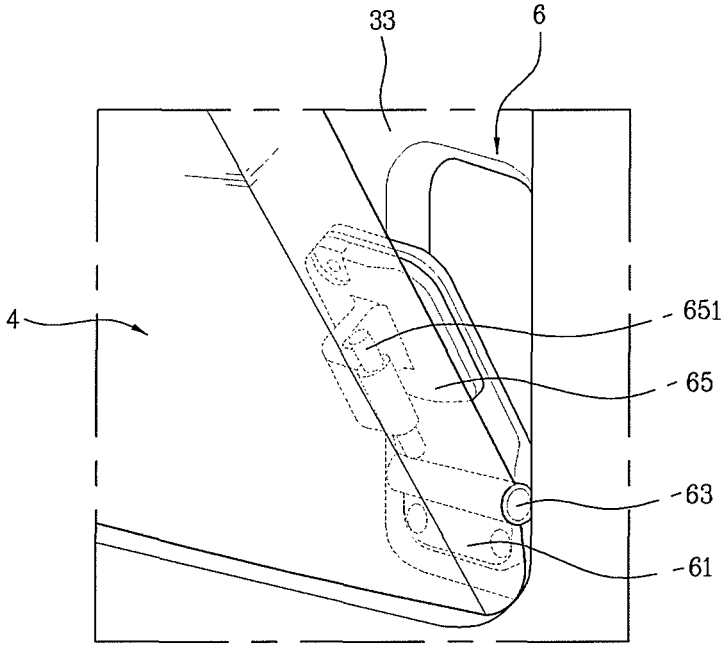
FIG. 5 is a diagram illustrating the second hinge which is rotated along a second rotational direction.

FIG. 4 is a diagram illustrating the second hinge which is rotated along a second rotational direction. FIG. 5 is a conceptual diagram illustrating an open stat of the door. As follows, the embodiment will be described in reference to FIGS. 4 and 5.

The second hinge 6 may couple the cabinet 3 to the door 4, to secure the door 4 in a state of being selectively rotatable along the first and second rotational directions. The second hinge 6 may allow the door 4 to be rotatably coupled to the cabinet 3 when the door 4 is rotated on both of the first and second pivots.

The second hinge 6 may include a cabinet securing part 61 secured to the cabinet 3 and a door securing part 65 secured to the door 4.

The second shaft 651 consisting of the first pivot may be provided in the door securing part 65. The door 4 may be rotated on the second shaft 651 along the first rotational direction and it may be rotated on the second shaft 651 with respect to the door securing part 65.

The door securing part 65 and the cabinet securing part 61 may be rotatable on the third shaft 63. The third shaft 63 may consist of the second pivot and the door 4 may be rotated on the third shaft 63 along the second rotational direction.

As shown in FIG. 4, the door securing part 65 and the cabinet securing part 61 may not be bent at the third shaft 63 when the door 4 is rotated along the first rotational direction. When the door 4 is rotated along the first rotational direction, no relative motion is generated between the door securing part 65 and the cabinet securing part 61. Because of that, the coupling between the door securing part 65 and the cabinet securing part 61 may be maintained without change.

A recess 42 recessed to a preset depth may be formed at a lower end of the door 4 and the recess 42 may provide a predetermined space where the cabinet securing part 61 is received. As shown in FIG. 5, the recess 42 may form a sufficient space not to generate interference between the cabinet securing part 61 and the lower end of the door 4 and the door 4 is rotated along the second rotational direction.

When the door 4 is rotated along the second rotational direction, the lower end of the door 4 may be moved toward the cabinet 3. As a result, a predetermined space has to be provided between the door 4 and the cabinet 3 to rotate the door 4 along the second rotational direction. For that, the recess 42 may be formed at the lower end of the door 4 and the door 4 may be rotated as far as the space provided by the recess 42 accordingly.

As shown in FIG. 5, when the door 4 is rotated along the second rotational direction, the door securing part 65 and the cabinet securing part 61 may be bent at the third shaft 63. In other words, when the door 4 is rotated along the second rotational direction, the door 4 may not be rotated along the first rotational direction and the door 4 may not be rotated on the second shaft 651 accordingly.

Figure 6:
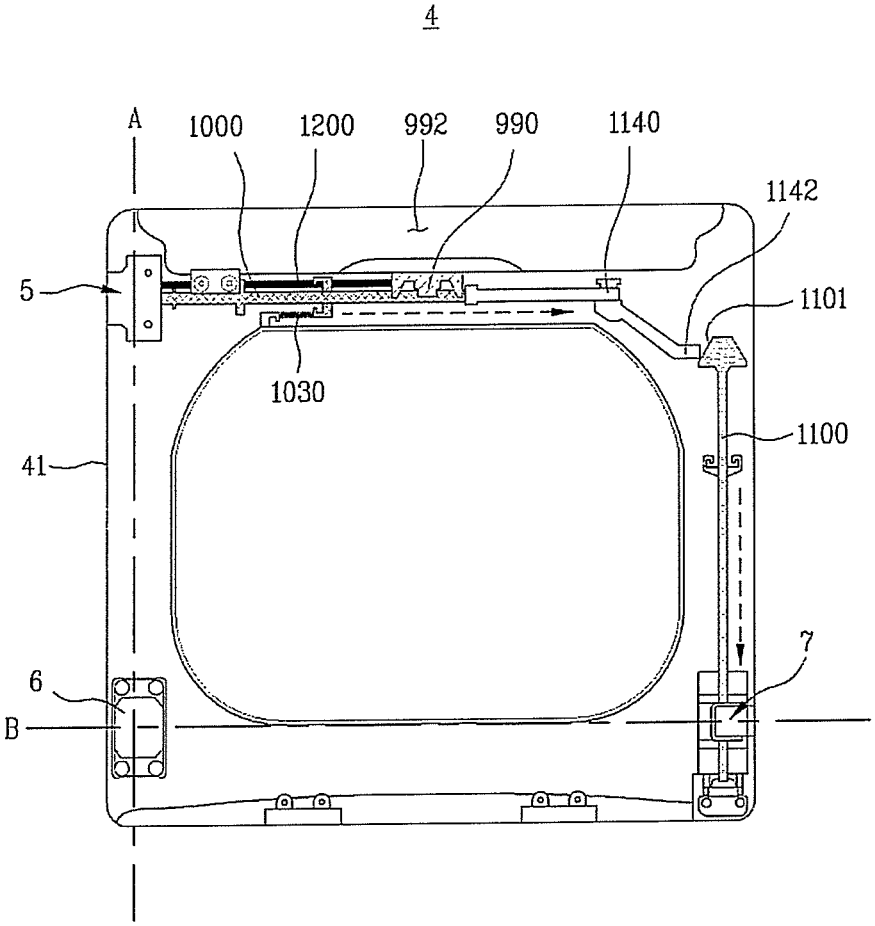
FIG. 6 is a diagram illustrating an inside of an outer frame provided in the door shown in FIG. 1.

FIG. 6 illustrates an inside of the outer frame provided in the door shown in FIG. 1. As follows, the embodiment will be described in reference to FIG. 6.

In FIG. 6, the inner frame 43 is omitted from the door 4 to disclose various elements installed in the outer frame 41.

A line extended along a perpendicular direction with respect to the door 4 on the left side may mean the first pivot (A) and a line extended along a horizontal direction in a lower end portion may mean the second pivot (B). In other words, a first hinge 5 may be provided in a left upper end portion and a second hinge 6 may be provided in a left lower end portion and a third hinge 7 may be provided in a right lower end portion. Here, FIG. 6 only illustrates elements installed in the door 4. Because of that, among the first hinge 5, the second hinge 6 and the third hinge 7, anyone installed in the cabinet 3 may not be shown.

A securing member may be provided in the door 4 to secure the door 4 to the first pivot or the second pivot, when the door 4 is rotated on the first pivot or the second pivot.

The securing member may include a first bar 1000 and a second bar 1100 which may be moved by the operation of the pressing piece 990. In brief, when the user moves the pressing piece 990 after grasping it by the hand, the first bar 1000 may be moved left and the second bar 1100 may be moved downwardly.

In the meanwhile, a first connecting piece 1140 extended longitudinally may be provided at an end of the first bar 1000 and a second connecting piece 1142 may be provided at an end of the first connecting piece 1140, such that the horizontal motion of the first bar 1000 may be transmitted to the first connecting piece 1140 and the second connecting piece 1142.

The first connecting piece 1140 and the second connecting piece 1142 may have limited moving paths to move only along the horizontal direction. As a result, the horizontal moving distance of the first bar 1000 may be transmitted to the first connecting piece 1140 and the second connecting piece 1142 as it is.

An inclined surface 1101 may be formed at an upper end of the second bar 1100 and the second bar 1100 may be moved downwardly with respect to the horizontal moving distance of the second connecting piece 1142. The inclined surface 1101 may have a tapered shape that is getting narrower upwardly and wider downwardly. When the second connecting piece 1142 is moved right, the second bar 1100 may be moved downwardly.

In other words, the horizontal motion of the second connecting piece 1142 may be changed into the vertical motion of the second bar 1100. As a result, the first bar 1000 may be moved horizontally and the second bar 1100 may be moved vertically, with respect to the motion of the pressing piece 990.

In the meanwhile, a safety bar 1200 may be provided in the door 4 to limit the motion of the pressing piece 990. The safety bar 1200 may fix the present state of the pressing piece 990 for the pressing piece 990 to maintain the pressed state or the not pressed state.

The first bar 1000, the second bar 1100 and the safety bar 1200 will be described in detail in reference other drawings later.

Figure 7:
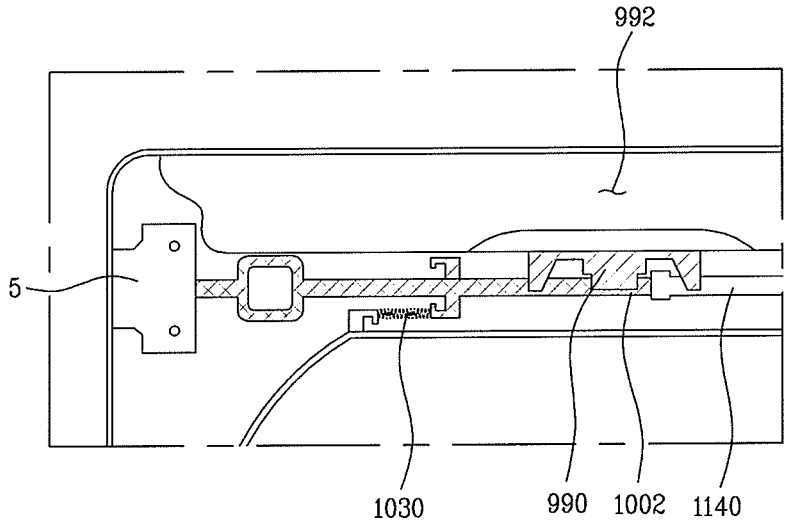
FIG. 7 is a front view illustrating a configuration of a first bar provided in the outer frame of the door.

FIG. 7 is a front view illustrating the configuration of the first bar provided in the outer frame of the door. As follows, the first bar will be described in reference to FIG. 7.

The first bar 1000 may secure the door 4 and the cabinet 3 for them to maintain the state of being coupled to the first pivot, when the door is rotated on the first pivot. Especially, the first bar 1000 may secure the door 4 rotatably coupled to the cabinet 3 at the first hinge 5, when the door 4 is rotated along the first rotational direction.

The first bar 1000 may be arranged at the end of the pressing piece 990 and the first bar 1000 may be moved as the pressing piece 990 is moved. A first elastic member 1030 may be provided in a predetermined portion of the first bar 1000 to restitute the first bar 1000 to an original position, when the force applied to the first bar 1000 is removed. At this time, the first elastic member 1030 may be a torsion spring. In other words, the first elastic member 1030 may be tensioned, because the first bar 1000 is moved toward a rightward direction in case the force pulling the first bar 1000 right is applied to the first elastic member 1030. In case the force applied to the first bar 1000 is removed, the first bar 1000 may be pulled left to be restituted to the original position.

A detailed shape of the first bar 1000 may be variable according to the inner configuration of the door 4. However, the first bar 1000 may have a configuration capable of transmitting the force generated in the pressing piece 990 to the first hinge 5.

Figure 8:
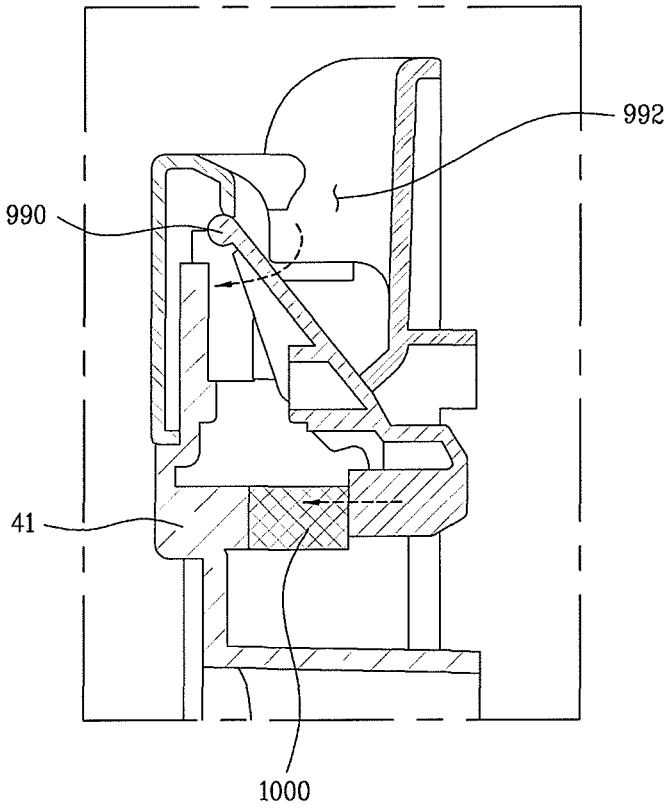
FIGS. 8 to 10 are diagrams specifically illustrating key parts when the first bar of FIG. 7 is operating.
Figure 9:
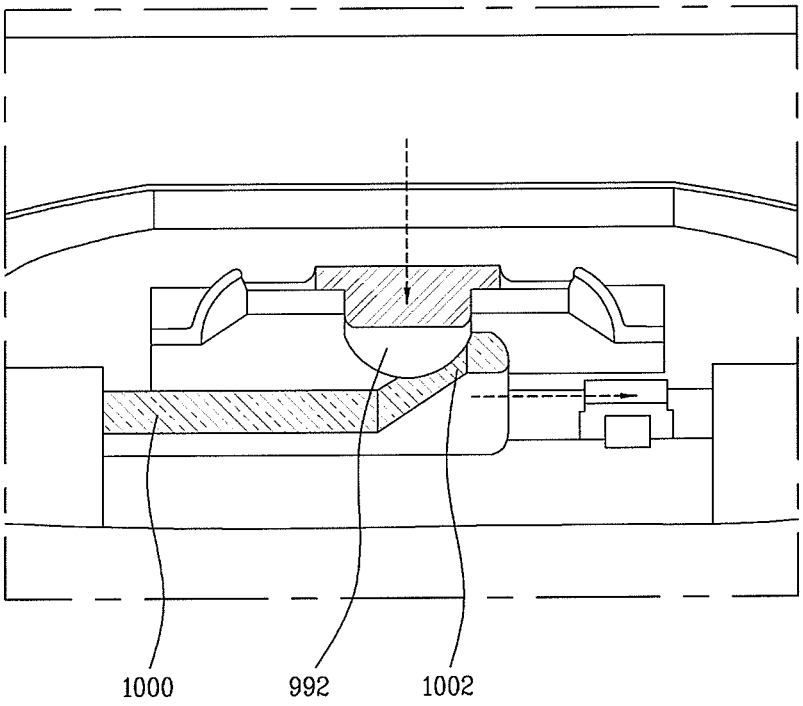
Figure 10:
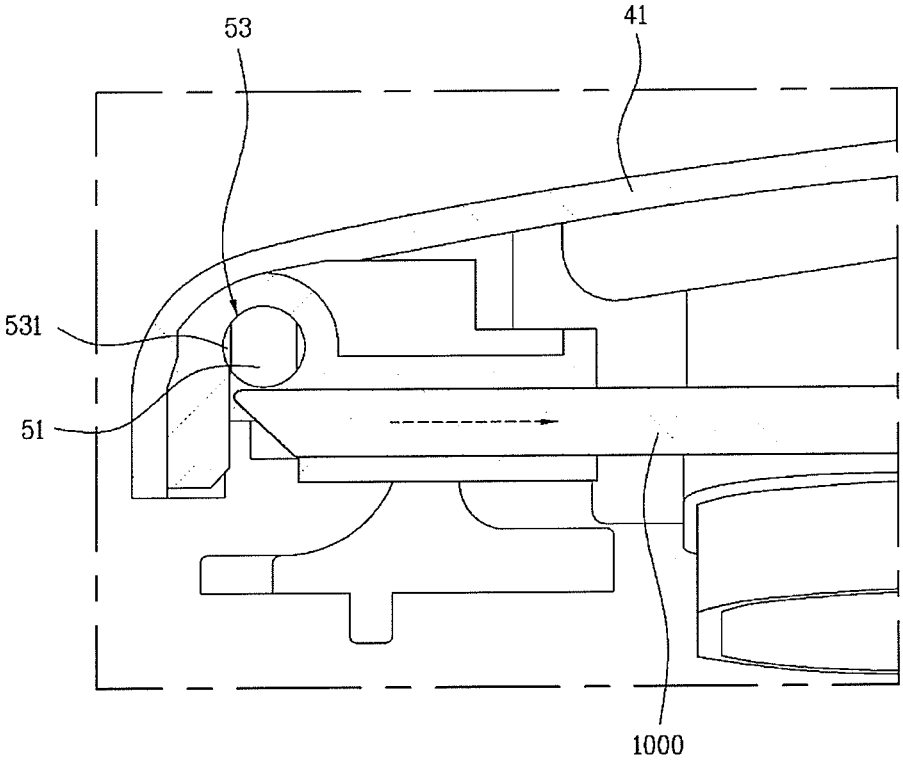

FIGS. 8 to 10 illustrate key parts in the operation of the first bar.

When the user tries to rotate the door 4 on the second pivot, the door 4 has to be detached from the cabinet 3 at the first hinge 5. To rotate the door 4 along the second rotational direction, the door 4 has to be rotatably secured to the cabinet 3 at the first hinge 7.

First of all, the user may grasp the pressing piece 990 of a recessed part 992 shown in FIG. 8 and he or she may push a lower end of the pressing piece 990, to rotate the pressing price 990 in a clockwise direction. In other words, when the user applies a force to the lower end of the pressing piece 990, the lower end of the pressing piece 990 may be moved to a leftward direction as shown in FIG. 8.

As shown in FIG. 9, an end of the pressing piece 990 may press the first bar 1000. A direction of a left arrow shown in FIG. 8 may be identical to a direction of a downward arrow shown in FIG. 9. At this time, a projected piece 1002 projected to be inclined may be formed at an end of the first bar 1000. When the end of the pressing piece 990 presses the projected piece 1002, the end of the pressing piece 990 has to move downward and the projected piece 1002 may be moved rightward. In other words, the downward motion of the pressing piece 990 may be changed into the rightward motion of the first bar 1000 by the projected piece 1002.

As shown in FIG. 10, the first bar 1000 may be moved right. As a result, the first receiving groove 531 receiving the first shaft 51 may be open and the first shaft 51 may be detached from the first receiving groove 531. As FIG. 10 illustrates schematically, it is not shown that the first shaft 51 is coupled to the cabinet 3. However, the first shaft detaching part 53 may be installed in the door 4 and the first shaft 51 may be installed to the cabinet 3, to be inserted in or detached from the first receiving groove 531.

When the first bar 1000 is closing the first receiving groove 531 as shown in FIG. 10, the first shaft 51 may not be detached from the first receiving groove 531 and the door 4 may be rotatable on the first shaft 51 with respect to the cabinet 3 accordingly. However, when the first bar 1000 is moved right by the operation mentioned above, the first shaft 51 received in the first receiving groove 531 may be detached from the first receiving groove 531 and it may not be coupled to the door 4 and the cabinet 3 via the first hinge 5 that the first shaft 51.

Different from the operation mentioned above, when the pressing piece 990 is not pressed, the first shaft 51 may be received in the first receiving groove 531 and the end of the first receiving groove 531 may be closed by the first bar 1000.

In other words, when the user tries to rotate the door along the first rotational direction, the door 4 has to be rotated on the first shaft 51 provided in the first pivot partially. As a result, the secured state between the door 4 and the first shaft 51 has to be maintained.

In this case, the user may grasp the recessed part 992 by the hand, without pressing the pressing piece 990. Because of that, the pressing piece 990 may not be moved. In this case, as the pressing piece 9990 it not pressed, the first bar 1000 may maintain the stopped state and the closed state of the first receiving groove 531. As a result, the first shaft 51 may form the first pivot, without being detached from the first receiving groove 531, to rotate the door 4 along the first rotational direction.

Figure 11:
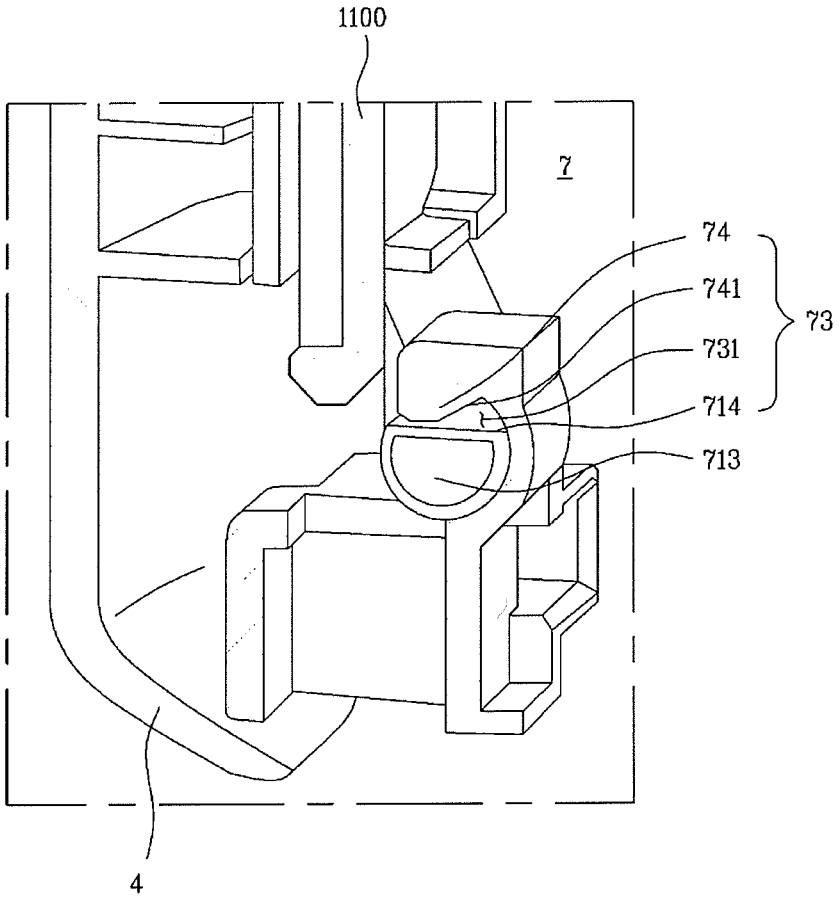
FIG. 11 is a diagram illustrating a coupling state of a third hinge.

FIG. 11 illustrates the coupling state of the third hinge.

The third hinge 7 may include a fourth shaft 713 forming the second pivot and a fourth shaft detaching part 73 having a second receiving groove 731 formed therein to detach the fourth shaft 713 there from. The fourth shaft 713 may be provided in the door 4 and the fourth shaft detaching part 73 may be provided in the cabinet 3, such that the fourth shaft 713 may be detachable from the fourth shaft detaching part 73.

In FIG. 11, the door 4 is closing the opening 37. Because of that, the fourth shaft 713 may be received in the second receiving groove 731 completely. At this time, when the user rotates the door 4 along the first rotational direction, the fourth shaft 713 may be detached from the second receiving groove 731 along a horizontal direction. The second bar 1100 may not close a horizontal entrance of the second receiving groove 731. Because of that, the fourth shaft 713 may have no inference of the second bar 1100 and it may be moved horizontally from the second receiving groove 731.

A sectional area of the fourth shaft 713 may have a first flat surface 714. At this time, an upper surface of the fourth shaft 713 may have the first plate surface 714 formed in a 'D' shape. Alternatively, two flat surfaces may be provided in both opposite sectional areas of the fourth shaft 713.

In the meanwhile, a stopper 74 may be formed in the second receiving groove 731 to stop the fourth shaft 713 from being rotated a preset angle or more. Also, a second flat surface 741 may be formed in the stopper 74, corresponding to the first flat surface 714. When the fourth shaft 713 is rotated, the first flat surface 714 may surface-contact with the second flat surface 741 and the rotation of the fourth shaft 713 may be stopped.

Figure 12:
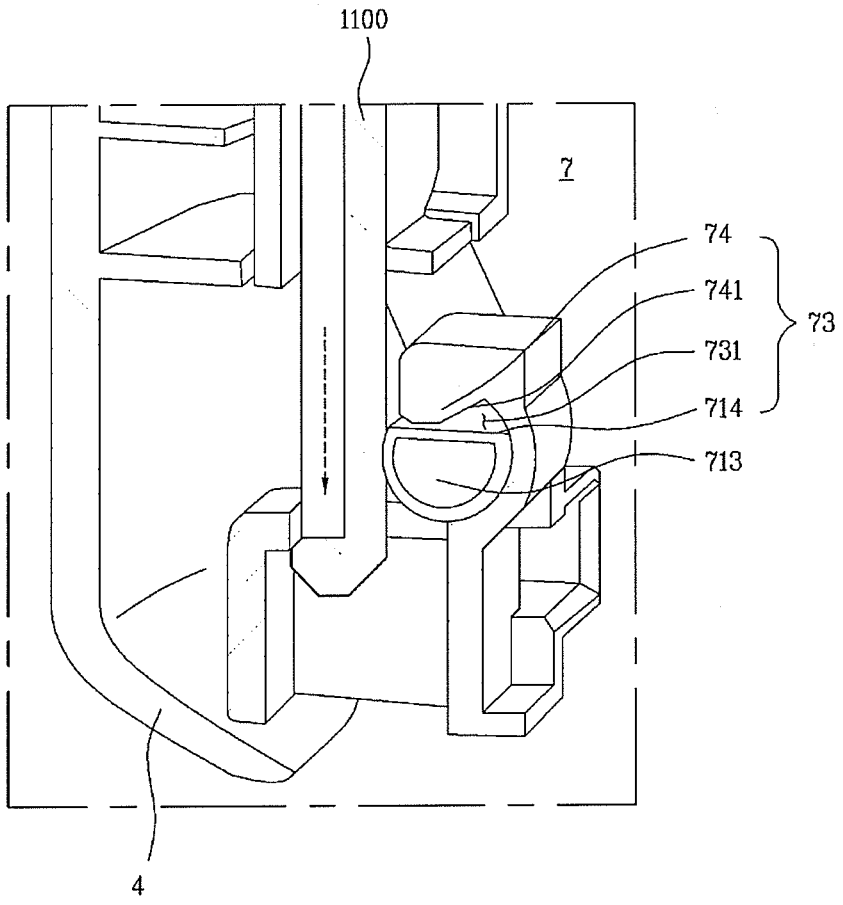
FIG. 12 is a diagram illustrating a second bar of FIG. 11 which is moving downwardly.

FIG. 12 illustrates the second bar of FIG. 11 is moved downwardly. As follows, the second bar will be described in reference to FIG. 12.

When the user tries to rotate the door 4 along the second rotational direction, the user may press the pressing piece 990 as shown in FIGS. 8 and 9. Once the pressing piece 990 is pressed, the first bar 1000 may be moved right. At this time, the first connecting piece 1140 and the second connecting piece 1142 may be moved right along the first bar 1000, such that the second bar 1100 may be moved downwardly (see FIG. 6).

If then, the second bar 1100 may be moved to a lower position shown in FIG. 12 from a position shown in FIG. 11. As a result, the second bar 1100 may close the second receiving groove 731 and the fourth shaft 713 may be stopped from being detached from the second receiving groove 731.

When the fourth shaft 713 is detached horizontally, it means that the door 4 is rotated along the first rotational direction mentioned above. As a result, the door 4 may be prevented from being rotated along the first direction simultaneously, while it is rotated along the second rotational direction.

In this case, the pressing piece 990 may be operated and the first bar 1000 also may be moved right. The first shaft 51 may be detached from the first receiving groove 531 as shown in FIG. 10 and the door and the cabinet 3 may be separated from the first hinge 5. As a result, the door 4 may be rotated along the second rotational direction.

Alternatively, when the user tries to rotate the door 4 along the first rotational direction, the pressing piece 990 may not be pressed by the user. As a result, the first bar 1000 and the second bar 1100 may maintain the original state, without being operated. In other words, the second bar 1100 may be moved downwardly as shown in FIG. 12 but arranged in the position as shown in FIG. 11. Because of that, the fourth shaft 713 may be detached from the second receiving groove 731 and the door 4 may be rotated along the first rotational direction.

Figure 13:
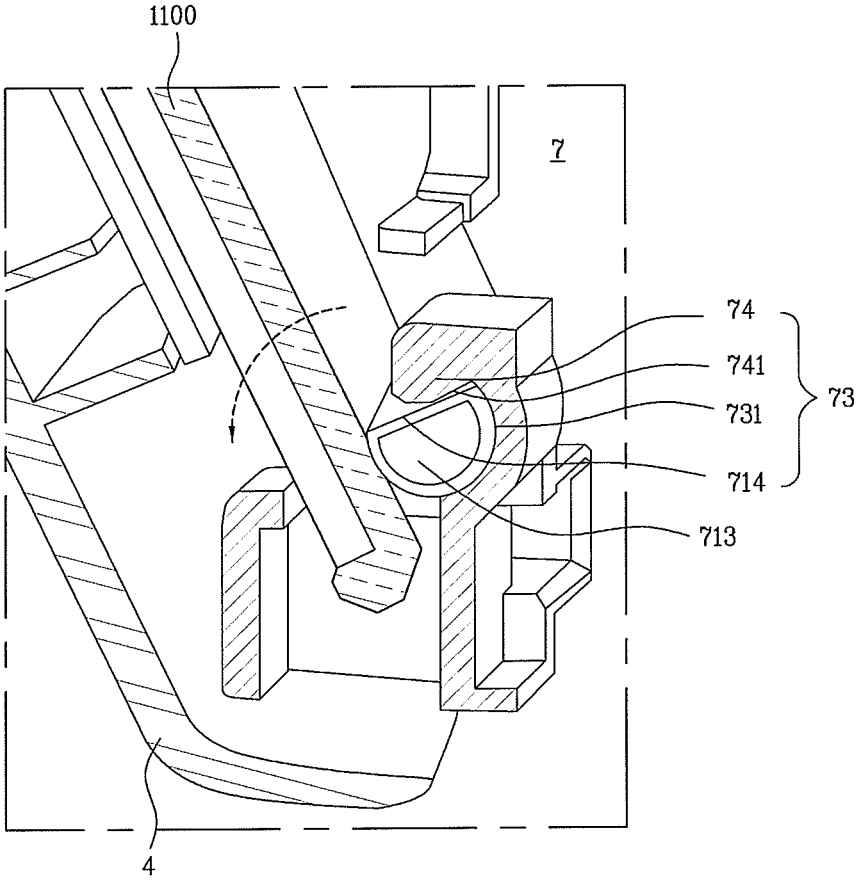
FIG. 13 is a diagram illustrating the door shown in FIG. 12 which is rotated along a second rotational direction.

FIG. 13 illustrates that the door of FIG. 12 is rotated along the second rotational direction. As follows, the door rotated along the second rotational direction will be described in reference to FIG. 13.

As shown in FIG. 13, when the door 4 is rotated along the second rotational direction, the fourth shaft 713 and the second bar 1100 which are installed in the door 4 may be rotated an identical angle, following the door 4.

At this time, when the first flat surface 714 of the fourth shaft 713 contacts with the second flat surface 741 of the stopper 74, the rotation of the fourth shaft 713 may be stopped. This is because the first flat surface 714 and the second flat surface 741 are flat to stop the first flat surface 714 from being rotated a predetermined angle of the second flat surface 741.

As a result, the door 4 may not be rotated any further to be stopped. At this time, the second rotational direction rotation angle of the door 4 may be approximately 30 degrees. The angle may be changeable according to the user convenience.

Figure 14:
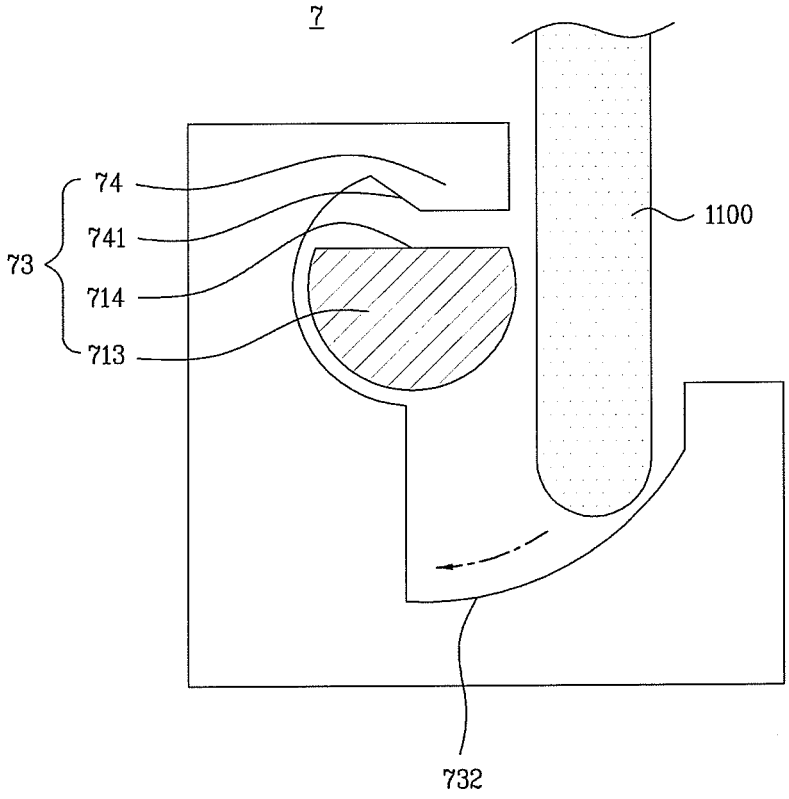
FIG. 14 is a conceptual diagram illustrating a converted example of FIG. 11.

FIG. 14 is a conceptual diagram illustrating a converted example of FIG. 11. As follows, the converted example will be described in reference to FIG. 14.

Different from FIG. 11, FIG. 14 shows a guide groove 732 may be formed to guide rotation of an end of the second bar 1100. The guide groove 732 may have a gently curved surface. In other words, the fourth shaft detaching part 73 may include the second receiving groove 731 and the guide groove 732.

When the door 4 is rotated along the second rotational direction, the second bar 1100 may be moved along the guide groove 732 limitedly. As a result, the end of the second bar 1100 may be freely moved, without being fixed, and noise or vibration may be reduced.

In the meanwhile, an end of the guide groove 732 may guide the second bar 1100 to move to a position enabling the door 4 to be stopped after rotated along the second rotational direction. In other words, the second bar 1100 may be stopped at the end of the guide groove 732 at the moment when the first flat surface 714 of the fourth shaft 713 contacts with the second flat surface 741.

Figure 15:
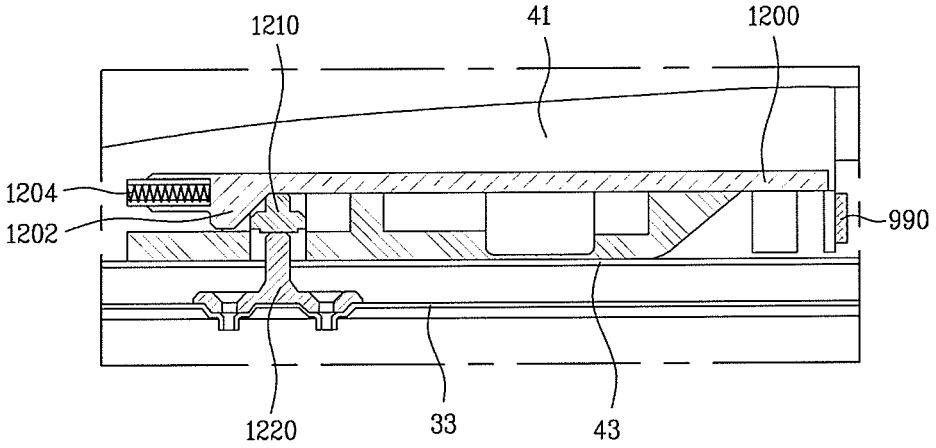
FIG. 15 is a diagram illustrating a configuration of a safety bar.

FIG. 15 illustrates the configuration of the safety bar and the configuration will be described in reference to FIG. 15.

The safety bar 1200 may be provided in the door 4 to limit the motion of the pressing piece 990. An end of the safety bar 1200 may be arranged adjacent to the pressing piece 990. A compression spring 1204 may be provided in a predetermined portion of the safety bar 1200 to elastically support the safety bar 1200. At this time, the compression spring 1204 may elastically support the safety bar 1200 moving right, unless a force is applied to the safety bar 1200.

The safety bar 1200 may include a projected piece 1202 projected a predetermined height to form an inclined surface.

In the meanwhile, a first pin 1210 may be fixed to the inner frame 43, with being vertically movable. An auxiliary guiding member may be provided in the inner frame 43 to guide the first pin 1210 to move only vertically.

The first pin 1210 may maintain the contact of the projected piece 1202 and the position of the safety bar 1200 may be movable according to the position of the first pin 1210 contacting with the projected piece 1202.

The first pin 1210 may be partially projected toward the inside of the door 4 and it may perform the vertical motion in the door 4 with respect to FIG. 15. In FIG. 15, the first pin 1210 may be moved upwardly to contact with the projected piece 1202, to limit the safety bar 1200 from moving right.

In the meanwhile, a second pin 1220 may be provided in the outer panel 33 of the cabinet 3 to press the first pin 1210. The second pin 1220 may be projected a predetermined height from the outer panel 33.

The first pin 1210 and the second pin 1220 may be independent elements. However, as shown in FIG. 15, the first pin 1210 and the second pin 1220 may be in contact in the state of the door 4 coupled to the cabinet 3.

In the state shown in FIG. 15, the safety bar 1200 may be moved left and it may not contact with the pressing piece 990. As a result, the pressing piece 990 may be freely movable, without the interference of the safety bar 1200.

Figure 16:
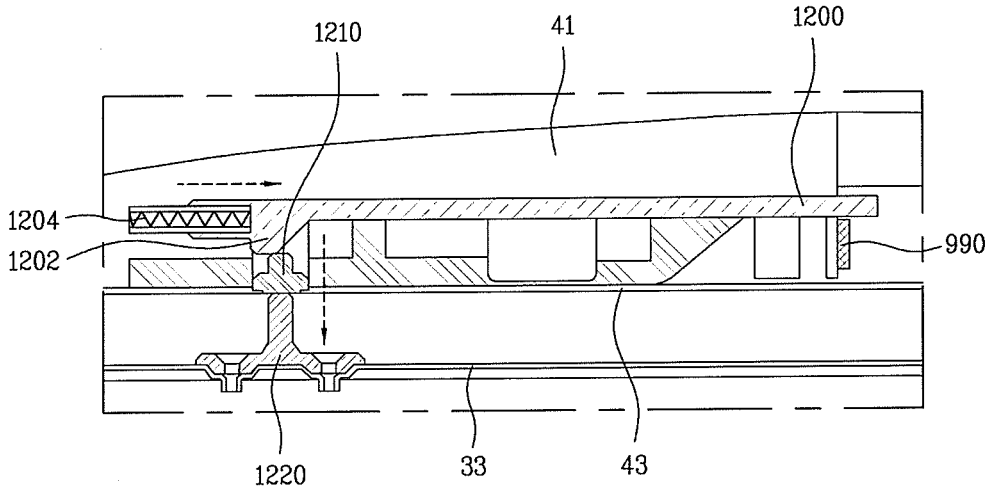
FIG. 16 is a diagram illustrating a detached state of FIG. 15 from the cabinet.
Figure 17:
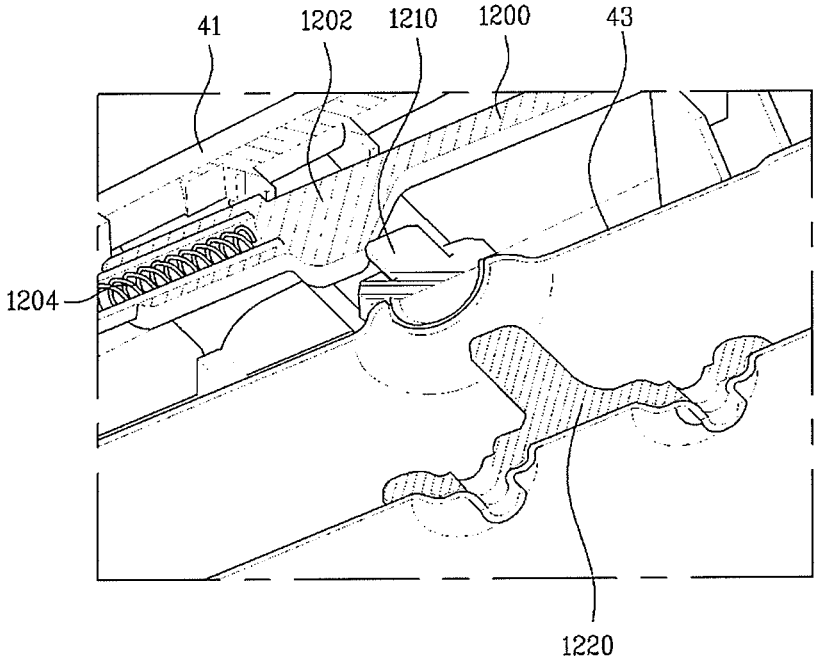
FIG. 17 is a diagram illustrating a safety bar, a first pin and a second pin shown in FIG. 16.

FIG. 16 is a diagram illustrating a detached state of FIG. 15 from the cabinet. FIG. 17 is a diagram illustrating a safety bar, a first pin and a second pin shown in FIG. 16.

In FIGS. 16 and 17, a distance between the outer panel and the inner frame 43 of the door may be larger than a distance between them in FIG. 15. In FIG. 16, it means that the door 4 is rotated a predetermined angle along the second rotational direction or the first rotational direction.

In the state shown in FIGS. 16 and 17, the second pin 1220 may be distant from the first pin 1210 for the second pin 1220 not to press the first pin 1210. As the second pin 1220 cannot press the first pin, the first pin 1210 may be moved to an original position. At this time, the original position of the first pin 1210 may be adjacent to the inner frame 43 along a downward direction with respect to FIG. 16.

The force moving the first pin 1210 upwardly may be removed and the first pin 1210 may be moved downwardly. The safety bar 1200 may be moved right by the restitution force of the compression spring 1204.

In the safety bar 1200 may be moved right in the state shown in FIG. 16, compared with the state shown in FIG. 15. Because of that, the safety bar 1200 may contact with the pressing piece 990. Specific examples of the safety bar 1200 coupled to the pressing piece 990 will be described later in reference to FIGS. 18 and 19. In the state shown in FIGS. 18 and 19, the motion of the pressing piece 990 may be limited by the safety bar 1200.

In other words, when the door 4 is rotated a predetermined angle or more along the first rotational direction or the second rotational direction after detached from the cabinet 3 as shown in FIG. 16, the pressing piece 990 may be pressed by the user's force and the safety bar 1200 may limit the motion of the first bar 1000 and the second bar 1100.

In the meanwhile, the first pin 1210 may be embedded not to be exposed outside the door 4. When the first pin 1210 is projected outside the door 4, especially, the inner frame 43, the laundry might be hooked by the first pin 1210 when the user is loading the laundry into the opening 37. If the laundry is hooked to the first pin 1210, the first pin 1210 might be pressed to move the safety bar 1200 left and the pressing piece 990 might be moved accordingly.

Figure 18:
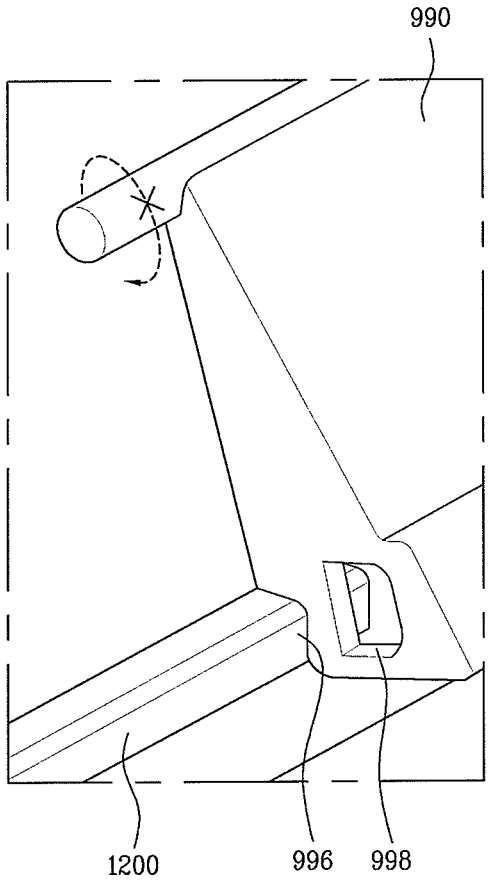
FIGS. 18 and 19 are diagrams illustrating a coupling state between the safety bar and a pressing piece shown in FIG. 16.
Figure 19:
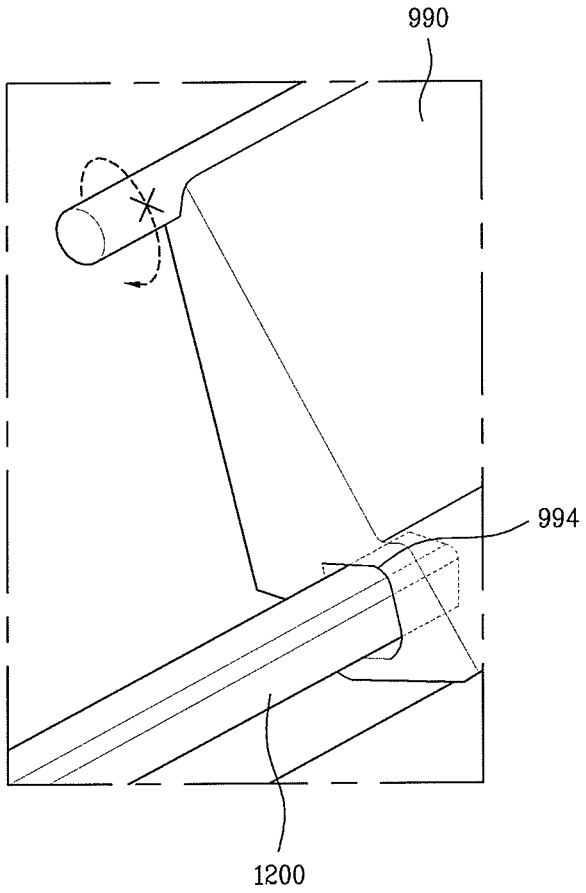

FIGS. 18 and 19 are diagrams illustrating a coupling state between the safety bar and a pressing piece shown in FIG. 1. As follows, the coupling state will be described in reference to FIGS. 18 and 19.

As shown in FIG. 18, a seating protrusion 996 may be formed in a predetermined portion of the pressing piece 990 which is not pressed and the safety bar 1200 may be seated on the seating protrusion 996 configured to limit the motion of the pressing piece 990. FIG. 18 illustrates the safety bar 1200 which is moved right a predetermined distance from the state of FIG. 16 and the safety bar 1200 may be seated on the seating protrusion 996 accordingly.

When the safety bar 1200 is seated on the seating protrusion 996, the pressing piece 990 may be limited from moving toward an arrow direction. The safety bar 1200 may be configured to be movable only right and left (horizontally).

As shown in FIG. 19, a through hole 998 may be formed to insert the safety bar 1200 therein in the state of the pressing piece 990 being pressed. In FIG. 19, the pressing piece 990 is rotated a predetermined angle, compared with in FIG. 18. FIG. 19 illustrates the state of the safety bar 1200 moved right a predetermined distance from the state of FIG. 16. Because of that, the safety bar 1200 may be inserted in the through hole 998.

When the safety bar 1200 is seated on the seating protrusion 996 or inserted in the through hole 998, the pressing piece 990 may not be moved even though pressed by the user.

In other words, the pressing piece 990 may not be fixed in the state shown in FIG. 15 and the user may freely press the pressing piece 990. However, the door 4 may be open from the cabinet 3 in the state shown in FIG. 16 and the safety bar 1200 may be moved along the rightward direction. Because of that, the user cannot press the pressing piece 990.

The pressing piece 990 may not be moved by the configuration of the safety bar 1200 in the state of the second pin 1220 not pressing the first pin 1210 after the door 4 is partially rotated along the first rotational direction or the second rotational direction from the cabinet 3, even through the user applies the force to the pressing piece 990. As a result, the door 4 may be prevented from rotated along the first and second rotational directions simultaneously when the user operates the pressing piece 990.

Figure 20:
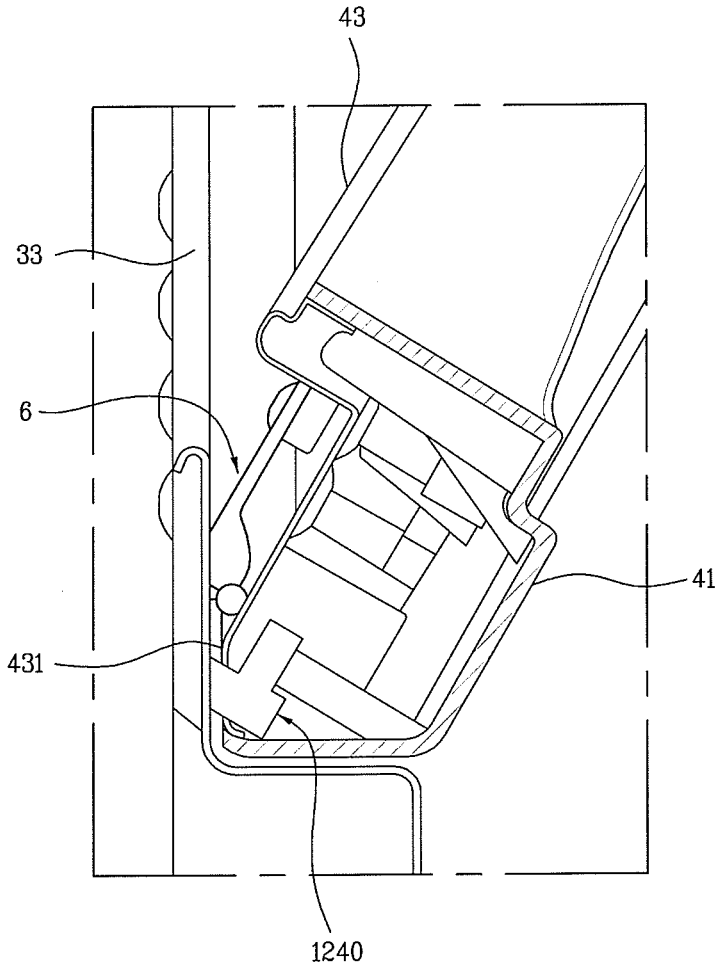
FIG. 20 is a sectional view illustrating a state of the door according to the embodiment being rotated along the second rotational direction.

FIG. 20 is a sectional view illustrating a state of the door according to the embodiment being rotated along the second rotational direction. As follows, the state of the door will be described in reference to FIG. 20.

An inclined piece 431 may be formed at a lower end of the door 4. Especially, the inclined piece 431 may be formed at a lower end of the inner frame 43 provided in the door 4. The recess 42 mentioned above may be formed in the portion where the second hinge 6 is located. In contrast, the inclined piece 431 may be broadly formed in a lower center portion of the door 4.

In other words, as shown in FIG. 20, when the door 4 is rotated a predetermined angle along the second rotational direction, the inclined piece 431 may contact with the cabinet 3. That is, the inclined piece 431 may contact with the outer panel 33 of the cabinet 3 and the rotation of the door 4 may be stopped. In other words, the door 4 may be rotated along the second rotational direction until the inclined piece 431 contacts with the outer panel 33.

The lower end of the door 4 may have the inclined piece 431 inclined a predetermined angle, with no right-angled corner, only to rotate the door 4 a predetermined angle along the second rotational direction.

In the meanwhile, a damper part 1240 may be provided in the inclined piece 431 to absorb a shock generated by the door 4 and the cabinet 3. The damper part 1240 may be formed of rubber and it may have a flat surface that is similar to the inclined piece 431. However, the damper part 1240 may have various shapes only if it does not interfere with the rotation of the door along the second rotational direction.

Figure 21:
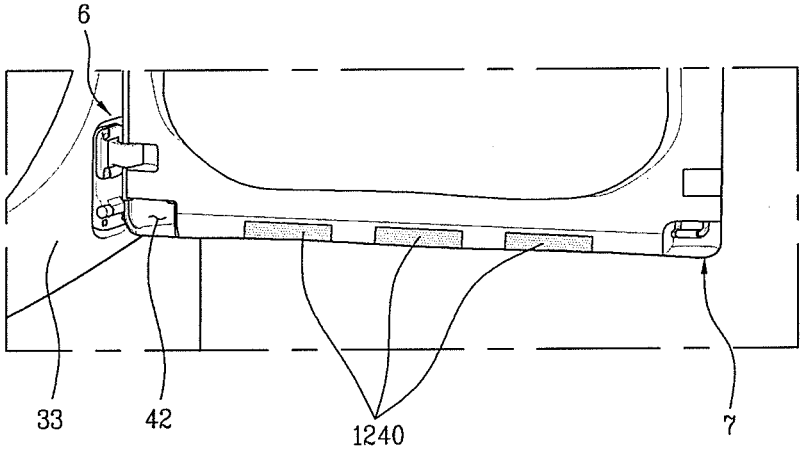
FIG. 21 is a diagram illustrating a damper part shown in FIG. 20.

FIG. 21 is a diagram illustrating a damper part shown in FIG. 20. As follows, the damper part will be described in reference to FIG. 21.

The plurality of the damper parts 1240 may be arranged along a longitudinal direction of the inclined piece 431. Different from FIG. 21, the damper part 1240 may be provided in the cabinet 3 not in the inclined piece 431. The damper part 1240 may be provided at a position where the inclined piece 431 collides with the cabinet 3 and the position of the damper part 1240 may be variable.

FIGS. 22 to 25 are conceptual diagrams illustrating a damper part according to various embodiments.

Figure 22:
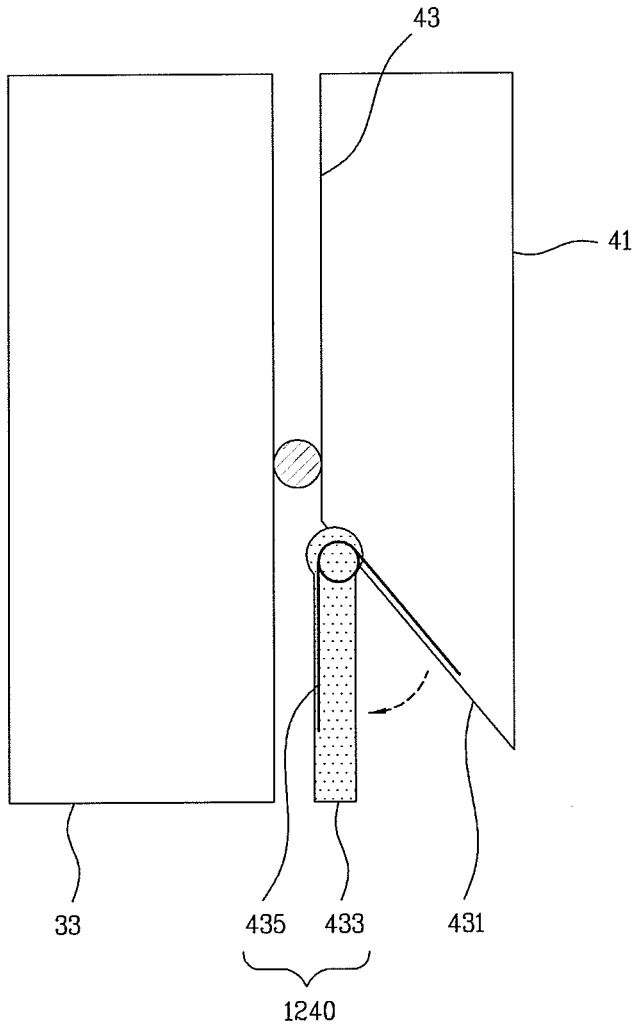
FIG. 22 is a conceptual diagram illustrating a damper part according to another embodiment.

A damper part 1240 shown in FIG. 22 may include a damping bar 433 configured to contact with the outer panel 33 of the cabinet 3, when the door 4 is rotated along the second rotational direction. The damping bar 433 may have a flat surface. Also, the damper part 1240 may include a torsion spring 435 configured to elastically support the portion between the inclined piece 431 and the damping bar 433. When a rotational force is applied to the torsion spring 435, the torsion spring 435 may provide a compression force against the rotational force. Because of that, the rotational speed of the door 4 may be decreased while the door 4 is rotated.

According to FIG. 22, while the door 4 is rotated along the second rotational direction, the damping bar 433 may contact with the outer panel 33 and the shock generated from the collision between the door 4 and the cabinet 3 as the torsion spring 435 may be reduced.

Figure 23:
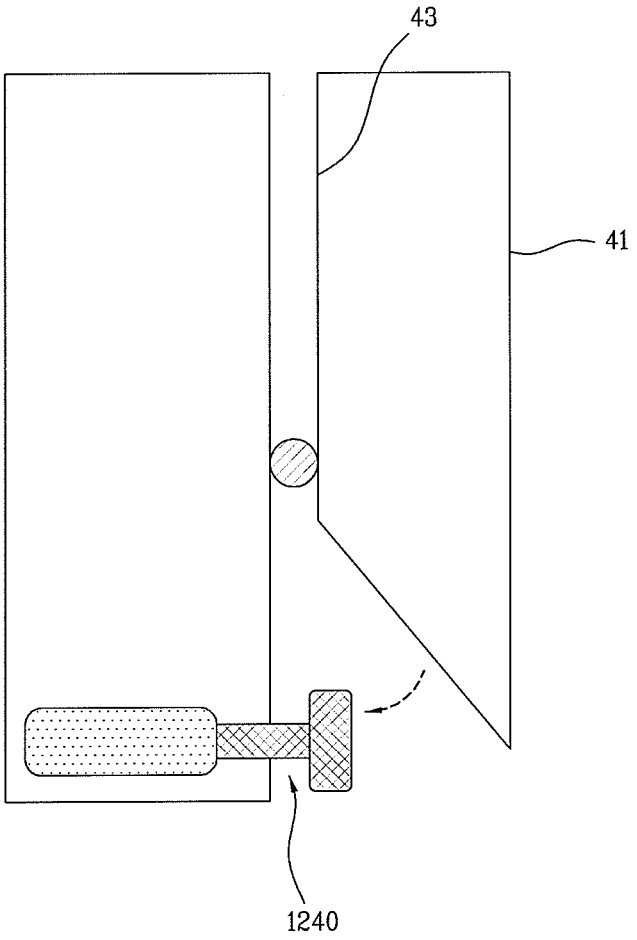
FIG. 23 is a conceptual diagram illustrating a damper part according to a further embodiment.

A damper part 1240 shown in FIG. 23 may be a gaseous or liquid spring. In other words, gas or liquid which can be compressed or expanded may be provided in a casing. When the damper part 1240 is collided against the damper part 1240, the gas or liquid provided in the casing may be compressed and the rotational speed of the door 4 along the second rotational direction may be then decreased. Because of that, the shock generated between the door 4 and the cabinet 3 may be reduced.

Figure 24:
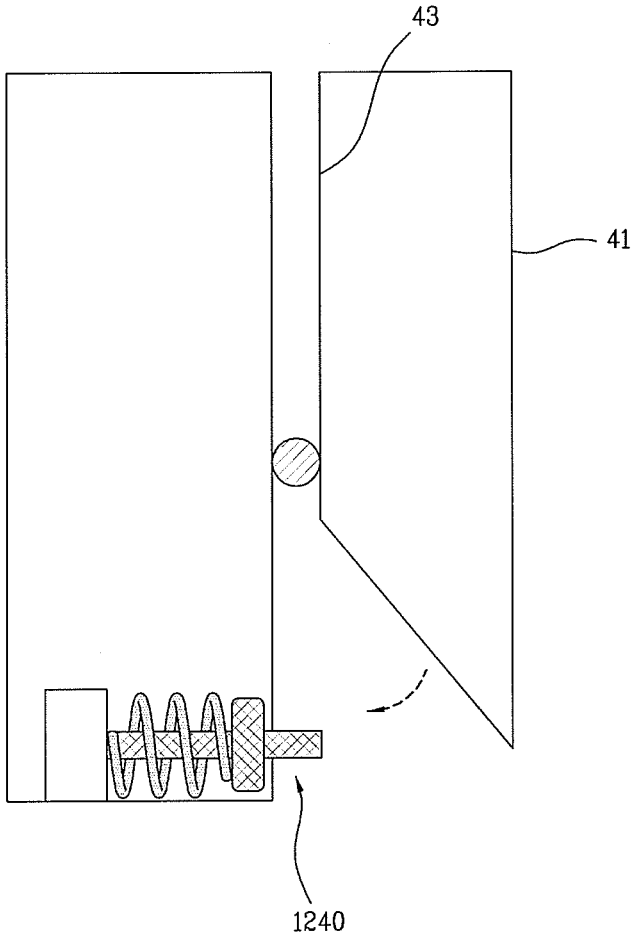
FIG. 24 is a conceptual diagram illustrating a damper part according to a still further embodiment.

A damper part 1240 shown in FIG. 24 may be a compression spring. Like the damper part 1240 according to the embodiments, the inclined piece 431 may contact with the damper part 1240 when the door 4 is rotated along the second rotational direction. After that, the inclined piece 431 may press the compression spring and the inclined piece 431 may press the compression spring. As the compression spring is pressed, the shock generated between the door 4 and the cabinet 3 may be absorbed.

Figure 25:
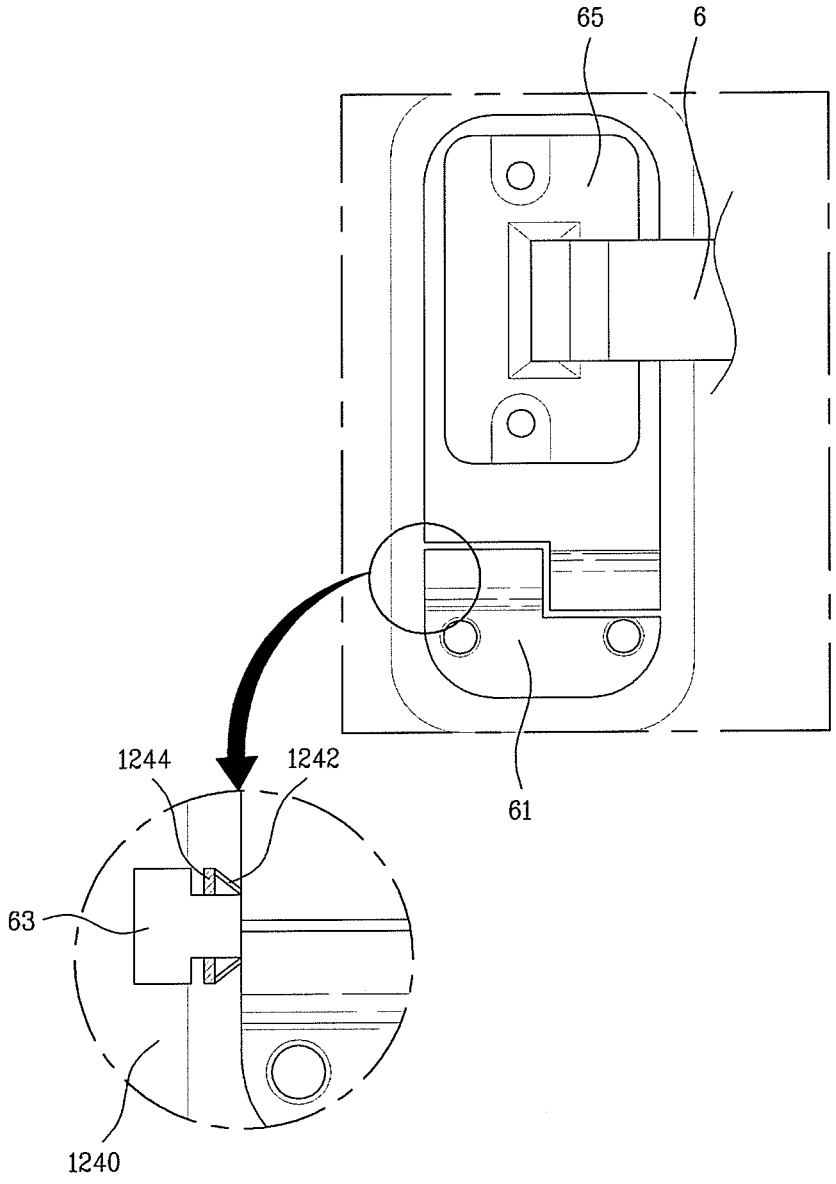
FIG. 25 is a conceptual diagram illustrating a damper part according to a still further embodiment.

A damper part 1240 shown in FIG. 25 may be installed in the second hinge 6, not in the inclined piece 431.

The second hinge 6 may include the door securing part 65 secured to the door 4 and the cabinet securing part 61 secured to the cabinet 3. At this time, a plain washer 1244 and a spring washer 1242 may be provided at an end of the cabinet securing part 61.

According to the embodiment shown in FIG. 25, friction may be generated in the spring washer 1242 when the door 4 is rotated along the second rotational direction. In other words, friction may be generated in the second hinge 6 because of the shape of the spring washer 1242, when the door 4 is rotated, and the rotational speed of the door 4 may be decreased by the generated friction. As a result, a shock generated by collision between the inclined piece 431 and the cabinet 3 which might be generated when the door 4 is rotated at a high speed along the second rotational direction.

Figure 26:
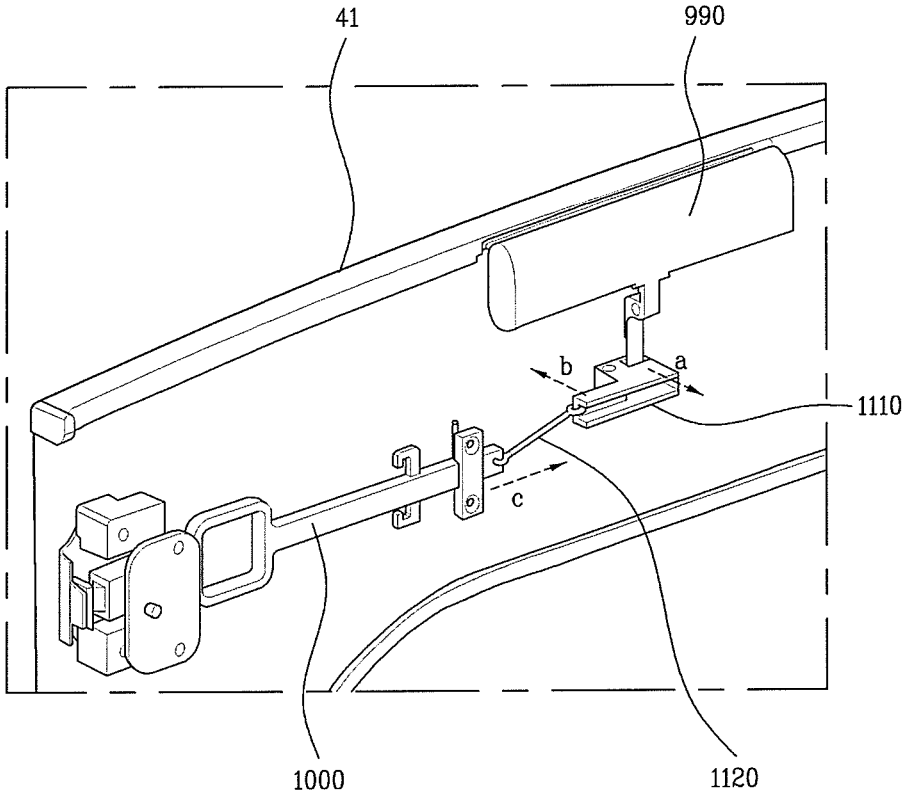
FIG. 26 is a conceptual diagram illustrating a first bar according to another embodiment.

FIG. 26 is a conceptual diagram illustrating a first bar according to another embodiment and the first bar according to the embodiment will be described in reference to FIG. 26.

In FIG. 26, the force generated in the pressing piece 990 may be transferred to the first bar 1000 via a first link 1110 and a second link 1120.

The pressing piece 990 may be rotatable on a horizontal pivot referenced to as a dotted line located in a lower center. In other words, when an upper end of the pressing piece 990 is pulled toward the outer frame 41 located in front of the door 4, a lower end of the pressing piece 990 may be pushed toward a rear surface of the door 4.

The first link 1110 may be rotatable on a perpendicular pivot referenced to as a dotted line located in the door 4. In the meanwhile, an end of the first link 1120 may be connected to the pressing piece 990, with being perpendicular to the horizontal pivot referenced to as the dotted line.

In the meanwhile, the second link 1120 and the first bar 1000 may be connected with each other by the second link 1120 and the motion of the second link 1120 may be transferred to the first bar 1000. The second link 1120 may be a beam. The end of the second link 1120 may be moved along the motion of the first link 110 and the other end of the second link 1120 may transfer the motion to the first bar 1000.

According to the operation of the embodiment shown in FIG. 26, when the user pulls the pressing piece 990 along an arrow of 'a', the lower end of the pressing piece 990 may be moved on the pivot along an arrow of 'b'. The pressing piece 990 may be fixed to the horizontal pivot referenced to as the dotted line in the door 4 and the arrow of 'a' may be the reverse of the arrow of 'b'.

Since the pressing piece 990 is coupled to the first link 110, the end of the first link 1110 may be moved along the arrow of 'b' together with the lower end of the pressing piece 990.

The first link 1110 may be secured to the perpendicular pivot referenced to as the dotted line in the door 4. When the end of the first link 1110 is moved along the arrow of 'b', the other end of the first link 1110 may be moved along the arrow of 'c'. The first link 1110 may be secured to the door 4 to be rotated on the pivot and the arrow direction of 'b' is the reverse of the arrow direction of 'c' because of that. In other words, the arrow direction of 'b' may mean the rear of the door 4 and the arrow direction of 'c' may mean the front of the door 4.

When the first link 1110 is moved along the arrow direction of 'c', the second link 1120 may be moved together with the first link 1110 and the first bar 1000 may be pulled along an arrow direction of 'd'. When the pressing piece 990 is pressed, the first bar 1000 may be moved right and the first receiving groove 531 may be open to detach the first shaft 51 from the first receiving groove 531 as mentioned above.

If the pressing piece 990 is not pressed by the user, the first link 1110, the second link 1120 and the first bar 1000 may not be moved.

Various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

As follows, a structure of a dryer according to a further embodiment will be described.

Figure 27:
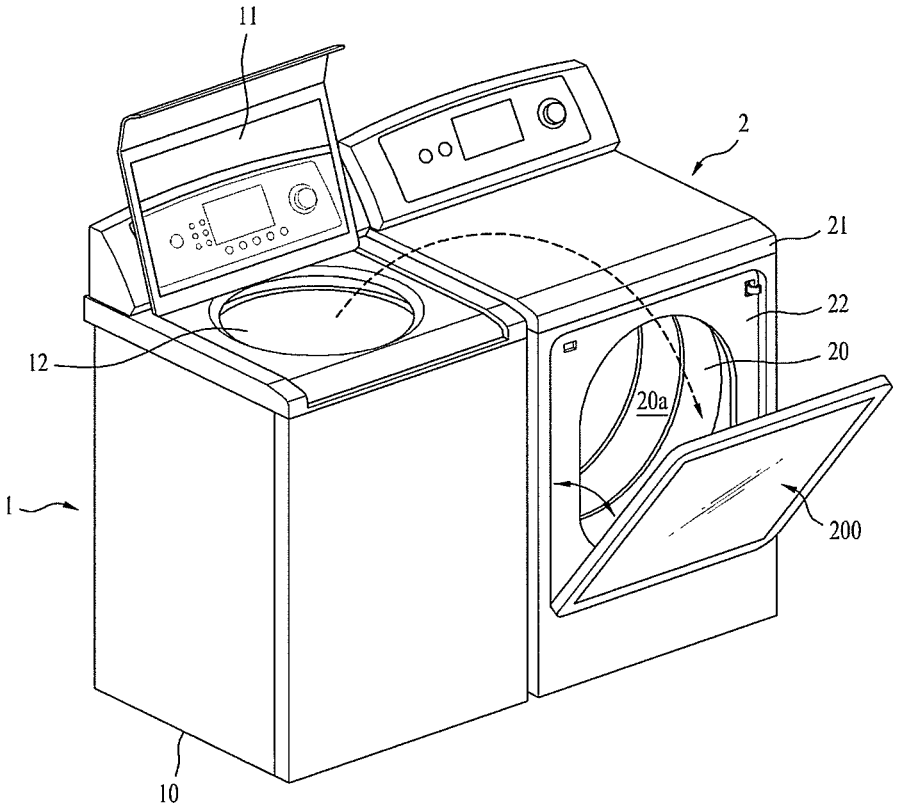
FIG. 27 is a perspective view illustrating a dryer according to a still further embodiment and a washing machine having the dryer.
Figure 28:
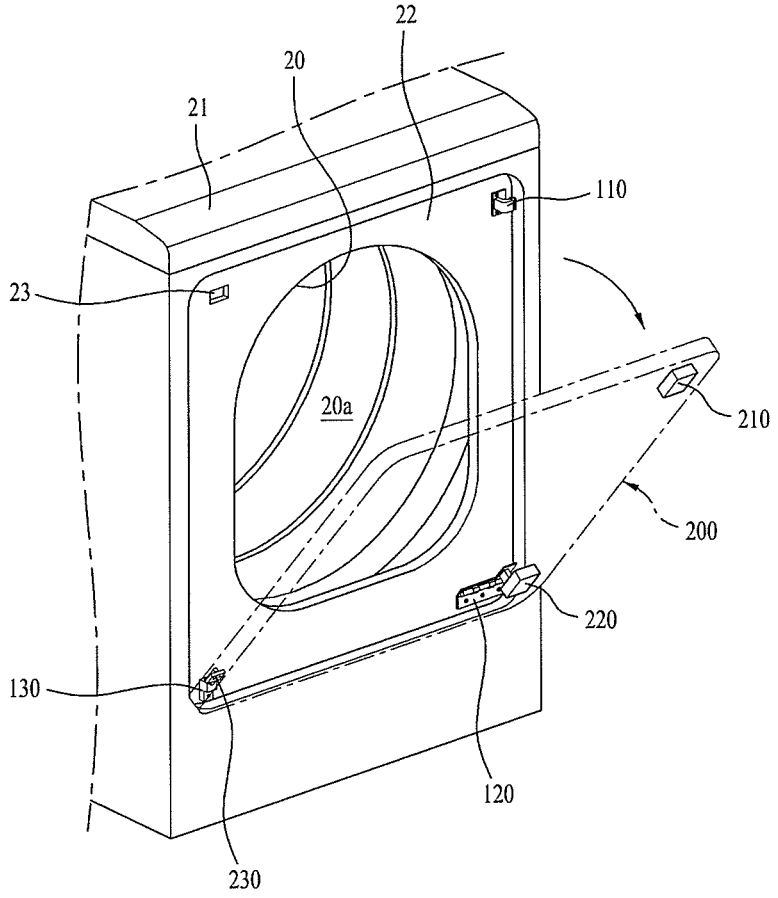
FIG. 28 is a perspective view partially illustrating a door provided in the dryer shown in FIG. 27, which is open and closed along a vertical direction.
Figure 29:
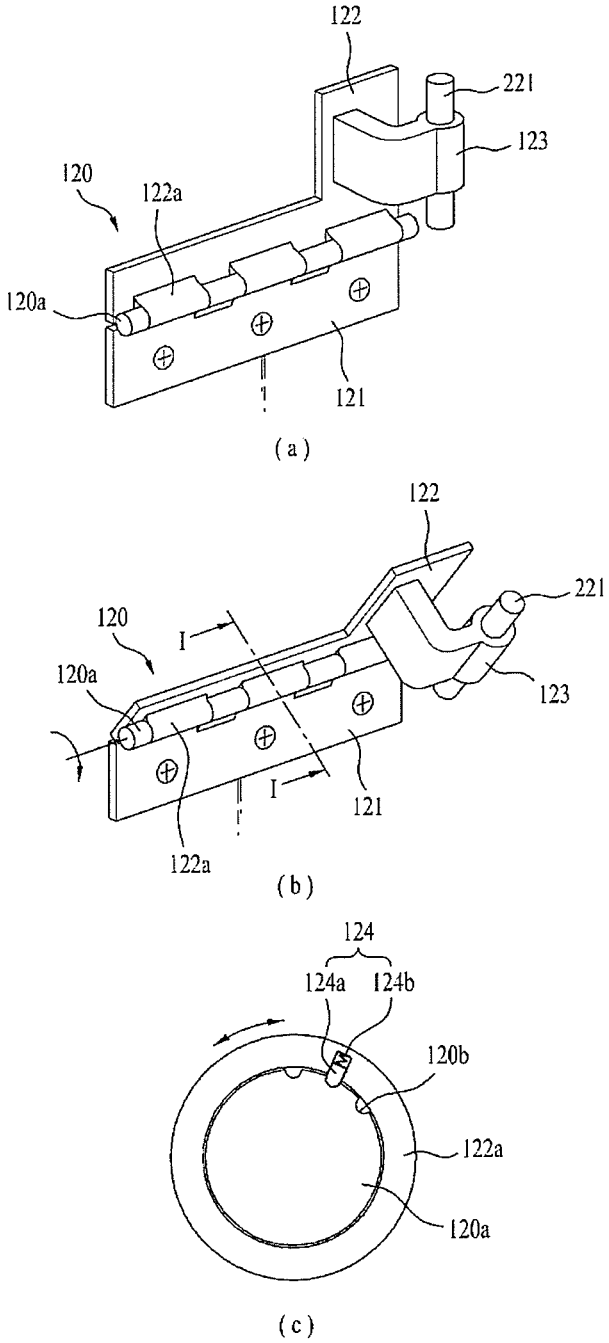
FIG. 29*a* is a perspective view illustrating a coupling relation between a second hooking member and a second shaft of a second hinge located in the door and FIG. 29*b* is a perspective view illustrating a vertical rotation state of the second hooking member shown in FIG. 28
FIG. 29*c* is a sectional view illustrating a fixing projection member elastically inserted in and separated from a fixing hole.
Figure 30:
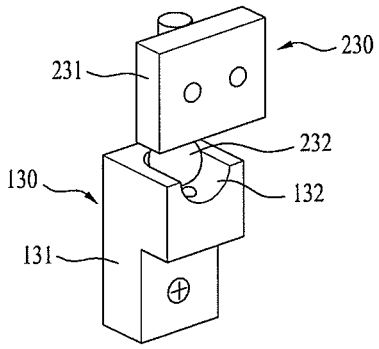
FIG. 30*a* is a perspective view illustrating a hingedly connecting relation between a rotation member shown in FIG. 28 and a rotation member in the door and FIG. 30*b* is a perspective view illustrating a vertical rotation state of the rotation member shown in FIG. 30*a;*
Figure 30:
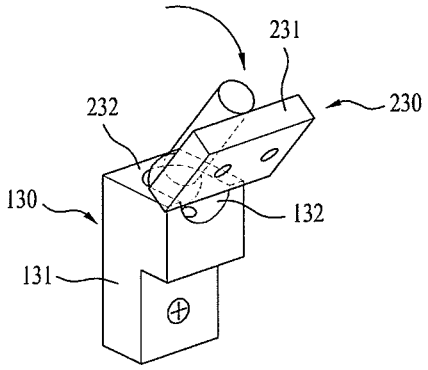

In reference to FIGS. 27 and 28, a dryer 2 according to this embodiment may include a dryer cabinet 21 having a drying room (20*a*) formed therein to dry drying objects (not shown) therein. Here, the drying room 20*a* may be a predetermined space where a drum rotated at a rotation speed set in a preset drying condition is arranged and an opening of the drying room may be exposed to outside by a drying object introduction opening 20 formed in a lateral surface of the cabinet 21.

The drying object introduction opening 20 may be opened and closed by a door 200 formed in a rectangular plate shape. A window may be installed in a center portion of the door 200 to enable the drying room 20*a* to be visible outside.

The door 200 may be multi-hingedly coupled to the cabinet 210 by a hinge unit and it may be selectively rotated to be open and closed along different directions.

Figure 32:
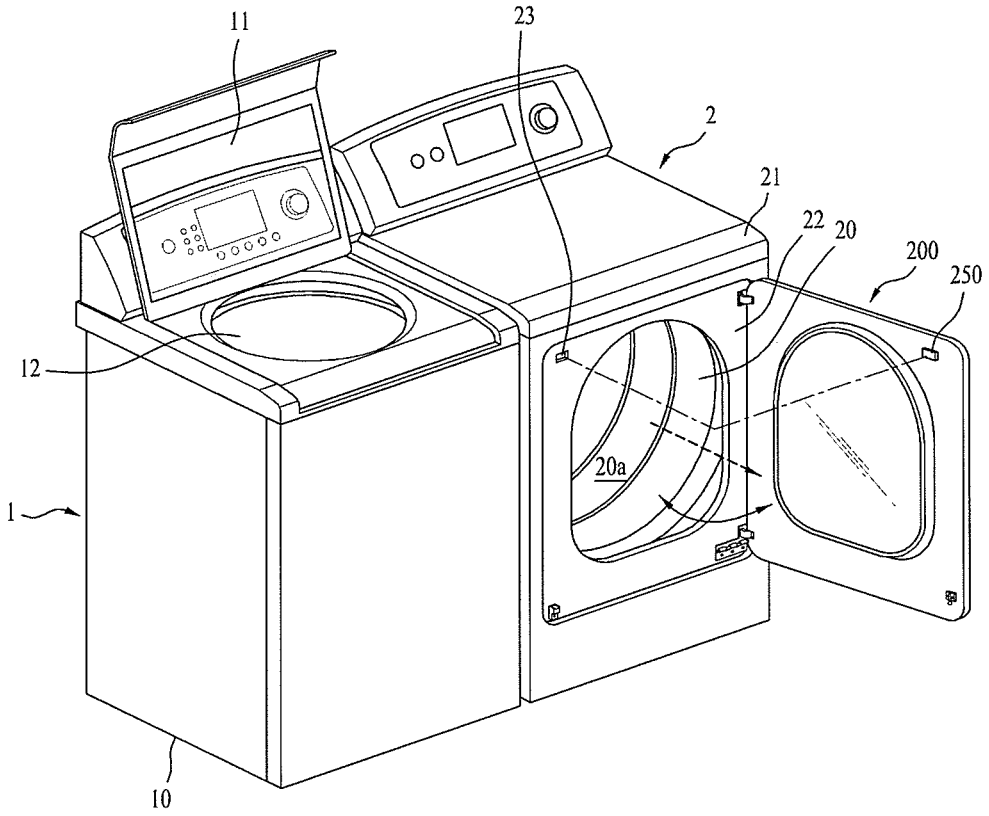
FIG. 32 is a perspective view illustrating a dryer having a door which is open along a horizontal direction as shown in FIG. 27 and a washing machine having the door.

As shown in FIGS. 27 and 32, the door 200 may be selectively open and closed along a vertical (an up and down direction) or horizontal direction (a right and left direction).

Here, the hinge unit configured to rotatably open and close the door 200 along the vertical or horizontal direction will be described.

The hinge unit may include a horizontal hinge part configured to open and close the door horizontally and a vertical hinge part configured to vertically open and close the door 200. In the meanwhile, an area adjacent to the drying object introduction opening 20 formed in the cabinet 21 may be stepped from an outer circumferential surface of the cabinet 210 and a guide plate 22 may be formed in the stepped portion to be in close contact with an inner surface of an outside of the door 200.

In reference to FIGS. 28 to 31, the vertical hinge part may include a second hooking member 120 installed in a predetermined portion of a lower end adjacent to the drying object introduction. opening 20, with being vertically rotatable and hinge-connected and with a second hook 122 formed therein to insert and detach a second shaft 221 of the second hinge 220 installed in a lower end of the door, which will be described later, therein and there from, a rotation hole member 130 installed in the other lower end adjacent to the drying object introduction opening 20, with a rotation hole member body 131 to form a rotation hole 132 therein, and rotation member 230 installed in the other lower end of the door 200, with a spherical-shaped rotation ball 230 formed therein to be inserted in the rotation hole 132 to freely rotate and with a rotation member body 231 fixed to a lower end of the door.

As shown in FIGS. 28 and 32, single hooking projection or a plurality of hooking projections 250 may be formed in the door 200, A single hooking groove or a plurality of hooking grooves 23 may be formed in the guide plate 22 consisting of the cabinet 21 near the drying object introduction opening 30 to insertedly hook the single one or the plurality of the hooking projections 250 thereto.

In the meanwhile, a vertical opening/closing angle of the door 200 may form a perpendicular angle or less.

A horizontal opening/closing angle of the door 200 may be a preset single value or a plurality of values selectively.

In this case, in reference to FIGS. 29*a* to 29*c*, the second hooking member 120 may include a rotation shaft 120*a* having fixing holes 120*b* formed in an outer circumferential surface thereof, spaced apart a predetermined distance from each other, a supporting body 121 hingedly connected to the rotation shaft 120*a*, with a surface fixed to the guide plate 22, and a rotation body 120 hingedly connected to the rotation shaft 120*a*, with a fixing projection member 124 formed an end thereof to elastically inserted and detached in and from the fixing hole 120*b* and with the second hook 123 projected outwardly there from.

Here, in reference to FIGS. 29*b* and 29*c*, the fixing projection member 124 may include a fixing holes 120*b* spaced apart a predetermined distance from each other along a circumferential direction of the rotation shaft 120*a*, a hole 124*c* formed in an inner circumferential surface of an inserting body 122*a* formed in the rotation body 120 to insert the rotation shaft 120*a*therein, a spring 124*b* installed in the hole 124*c*, and a fixing hail 124*a* connected to the spring 124*b* to he inserted in one of the fixing holes 120*b*.

As a result, when the rotation body 122 is rotated, the fixing ball 124*a* may be inserted in one of the fixing holes 2120*b* and an opening/closing angle of the door with respect to the guide plate 22 may be maintained.

Figure 33:
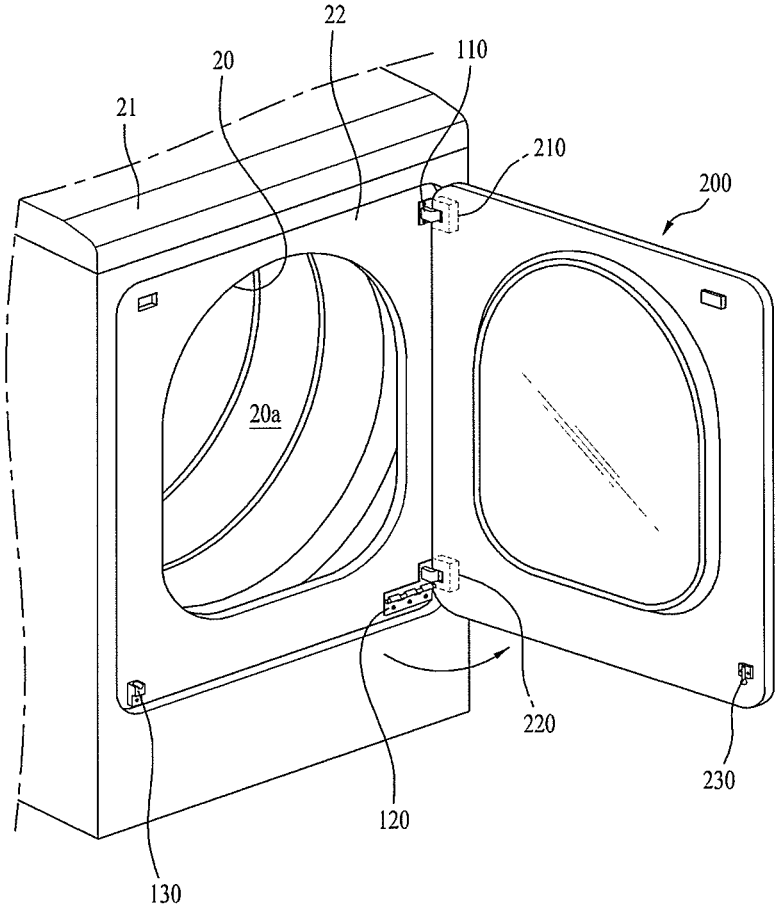
FIG. 33 is a perspective view illustrating the door of the dryer shown in FIG. 32, which is open and closed along the horizontal direction.
Figure 34:
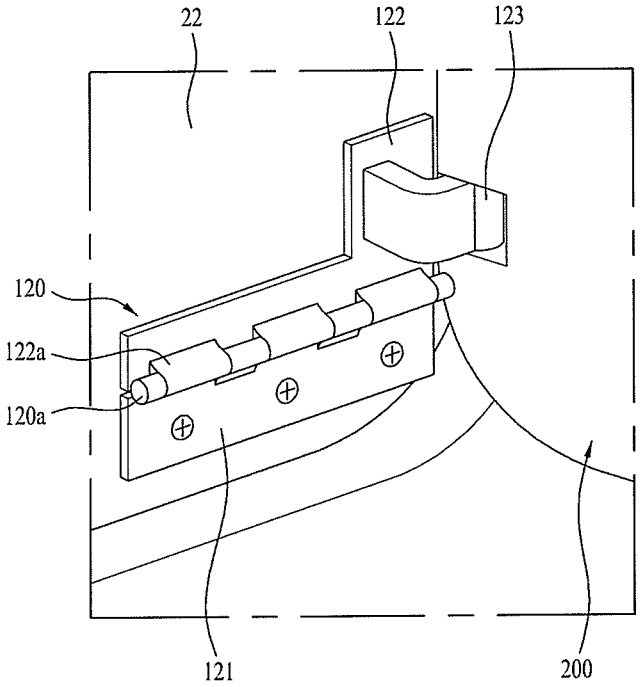
FIG. 34 is a perspective view illustrating a rotation state of a second hooking member and a second hinge member, when the door shown in FIG. 33 is open along the horizontal direction.
Figure 35:
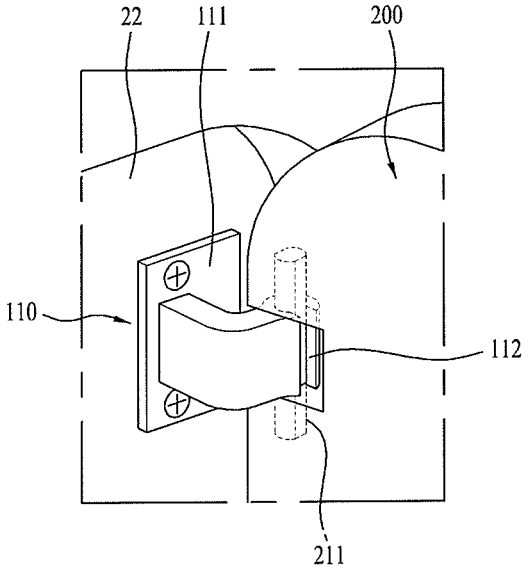
FIG. 35 is a perspective view illustrating a rotation state of a first hooking member and a first hinge member, when the door shown in FIG. 33 is open along the horizontal direction.
Figure 36:
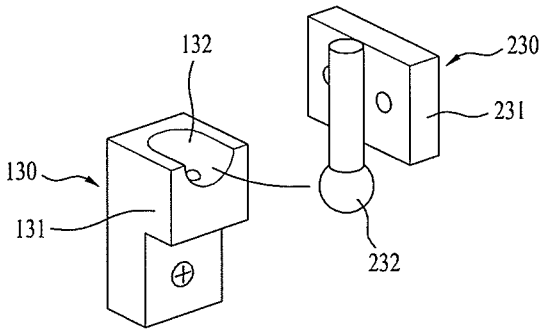
FIG. 36 is a perspective view illustrating a hingedly connecting relation between the rotation member shown in FIG. 33 and a rotation member of the door.

In reference to FIGS. 33 to 35, the horizontal hinge part may include a first hook body 111 installed in an upper end portion of the guide plate 22 adjacent to the drying object introduction opening 20, with a first hook body 111 having a first hook 112 formed therein, a first hinge member 210 installed in an upper end portion of the door 200, with a first rotation shaft 211 inserted in and detached from the first hook 112, and a second hinge member 220 installed in a lower end portion of the door 200, with a second rotation shaft 221. Here, the second rotation shaft 221 may be rotated, with being hooked to the second hook 123 of the second hooking member 120 mentioned above.

Next, the rotational opening/closing operation of the door along a vertical or horizontal direction will be described in reference to the configuration described above.

[Vertical Opening/Closing of Door]

In reference to FIGS. 27 to 31, when the door is vertically opened and closed, the door 200 may be rotated to be open and closed on a lower end thereof as a pivot. In other words, both lower ends of the door may be rotated.

In detail, in reference to FIGS. 28, 30*a* and 30*b* , the rotation ball 232 of the rotation member 230 provided in the other end of the door 200 inserted in the rotation hole 132 provided in the other end of the guide plate 22 may perform free rotation. In reference to FIGS. 29*a* and 29*b*, the second rotation shaft 221 of the second hinge member 220 provided in the end of the door 200 may be insertedly hooked to the second hook 123 of the second hooking member 120 hingedly provided in the end of the guide plate 22 and it may perform vertical rotation.

The door 200 may be rotated on the pivot passing the lower end of the door to be opened and closed vertically.

When the door 200 which can be vertically opened and closed closes the drying object introduction opening 20 airtight, the door 200 may maintain the airtight state (the closed state).

Figure 31:
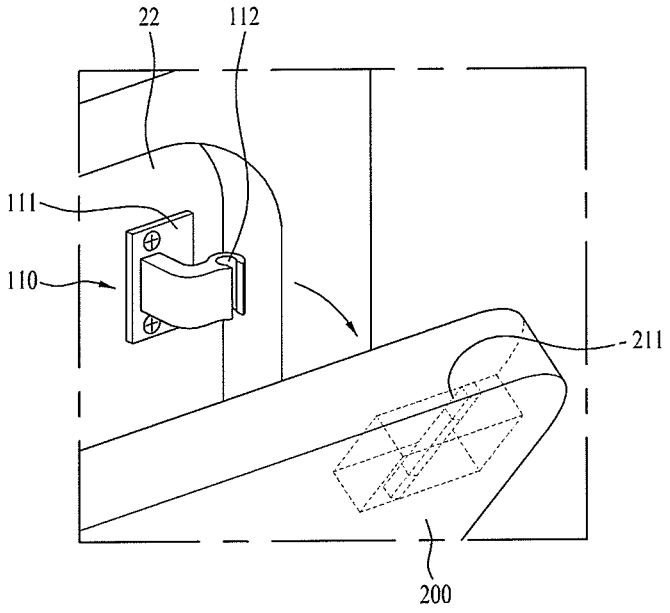
FIG. 31 is a perspective view illustrating a coupling relation between a first hooking member located in a dryer cabinet shown in FIG. 28 and a first hinge member located in a door.

In other words, as shown in FIG. 31, the first rotation shaft 211 of the first hinge member 210 provided in the upper end of the door 200 may be insertedly hooked to the first hook 112 of the first hooking member 110 formed in the end of the guide plate 22. In reference to FIG 32, the plurality of the hooking projections 250 provided inner surface of the door 200 may be hooked to the plurality of the hooking grooves 23 formed in the. guide plate 22 and the door 200 may maintain the closed state.

[Horizontal Opening/Closing Operation of Door]

In reference to FIGS. 32 to 36, when the door 200 is horizontally opened and closed, a lateral side of the door may be a pivot of the door rotation to open and close the door horizontally.

More specifically, the first rotation shaft 211 of the first hinge member 210 provided in the upper end of the door 200 may be rotated in a state of being insertedly hooked to the first hook 112 of the first hooking member 110 provided in the upper end of the guide plate 22. Also, as shown in FIGS. 29*a* and 34, the second rotation shaft 221 of the second hinge member 220 provided in the lower end of the door 200 may be rotated in a state of being insertedly hooked to the second hook 123 of the second hooking member 120 provided in the lower: end of the guide plate. As a result, the first and second rotation shafts 211 and 221 may form the same pivot.

As a result, the door 200 may be rotated on the pivot passing the lateral side of the door 200 to be horizontally opened and closed.

When the horizontally openable and closable door 200 closes the drying object introduction opening 20 airtight, the door 200 may maintain the airtight state (the closed state).

In other words, as mentioned above, the first rotation shaft 211 of the first hinge member 210 provided in the upper end of the door 200 may be insertedly hooked to the first hook 112 of the first hooking member 110 formed in the upper end of the guide plate 22, Also, as shown in FIG. 32, the plurality of the hooking projections 250 provided in the inner lateral surface of the door 200 may be hooked to the plurality of the hooking grooves 23 formed in the guide plate 22, such that the door 200 may maintain the closed state.

As follows, a laundry treating apparatus configured of the dryer 2 having the configuration mentioned above and the washer 1 connected with each other will be described.

In reference to FIG. 27, a conventional washer 1 may include a washer cabinet 10 having a washing room formed therm. A washing object introduction opening 12 may be formed in an upper portion of the cabinet 10, to expose the washing room outside upwardly and a cover 11 may be coupled to the washing object introduction opening 12 to open and close the opening 12.

The dryer 2 according to the embodiment mentioned above may be installed next to the washer cabinet 10. Here, the washer cabinet 10 and the dryer cabinet 21 may be integrally formed with each other or they may be connected with each other by auxiliary connection means (not shown).

In reference to the configuration described above, washing objects may be loaded into the washing room via the washing object introduction opening 12. In other words, the washing objects may be loaded along a vertical (up and down) path.

The washing objects may be unloaded via the washing object introduction opening 12 along the vertical path, after a washing process including a washing cycle and a spinning cycle.

Hence, the washed washing objects may be loaded into the dryer 2 as the drying objects to have the drying process.

At this time, the drying objects may be loaded into the drying room via the drying object introduction opening 20 exposed outside by the opening of the door 200 coupled to the lateral surface of the dryer cabinet 21 according to the embodiment.

At this time, the door 200 may be rotated to be open and closed on the lower end thereof as the pivot. When the drying objects are loaded into the drying room 20*a*, the door may be opened in state of being tilted downwardly. Here, the vertical opening/closing structure and method of the door 200 is described above and the description thereof will be omitted accordingly.

When the door 200 is rotated in a state of forming a preset opening/closing angle downwardly, the inner surface of the door 200 may form a tilted slope.

As a result, the drying objected washed in the washer 1 may fall from the upper portion of the tiltedly open door 200 and the falling drying objects may be introduced into the drying room 20*a* via the drying object introduction opening 20 along the inner surface of the door 200 tilted toward the drying object introduction opening 20 smoothly.

In other words, the reason why the door 200 opened and closed vertically is rotated downwardly to form the tilted angle is to guide the drying objects toward the drying object introduction opening 20 along the inner surface of the tilted door 200 smoothly.

Although not shown in the drawings, a guide partition wall may be further formed in each side portion of the inner surface of the door 200 to guide the drying objects sliding toward the drying object introduction opening 20, without falling outside. When the door 200 is closed, an inserting hole may be formed in the guide plate 22 to insert therein the guide partition wall projected from each side portion of the inner surface of the door 200.

After the drying objects are loaded into the drying room 20*a* according to the sliding method along the downward direction, the door 200 may be closed to close the drying object introduction opening 20 airtight.

The dryer 2 may perform drying for the drying objects loaded in the drying room 20*a* according to set drying conditions.

After the drying, the drying objects may be unloaded outside via the drying object introduction opening 20.

At this time, in reference to FIG. 32, the door 200 according to the embodiment may be rotated to be open and closed along the horizontal direction. Because of that, the door may be opened along the horizontal direction in case of unloading the drying objects.

As a result, in case of unloading the drying objects, the user may unload the drying objects located in the drying room 20*a* via the drying object introduction opening 20 smoothly.

As follows, a laundry treating apparatus according to a still further embodiment will be described in reference to the accompanying drawings.

Although embodiments have been described with reference to a number of illustrative embodiments thereof, it should be understood that numerous other modifications and embodiments can be devised by those skilled in the art that will fall within the spirit and scope of the principles of this disclosure.

Reference may now be made in detail to specific embodiments, examples of which may be illustrated in the accompanying drawings. Wherever possible, same reference numbers may be used throughout the drawings to refer to the same or like parts.

Figure 37:
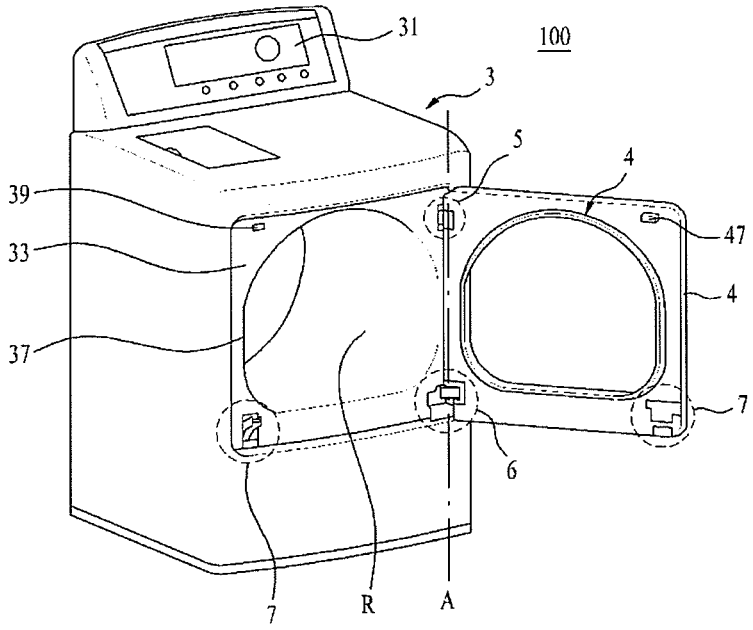
FIG. 37 is a perspective view illustrating a laundry treating apparatus according to a still further embodiment.
Figure 37:
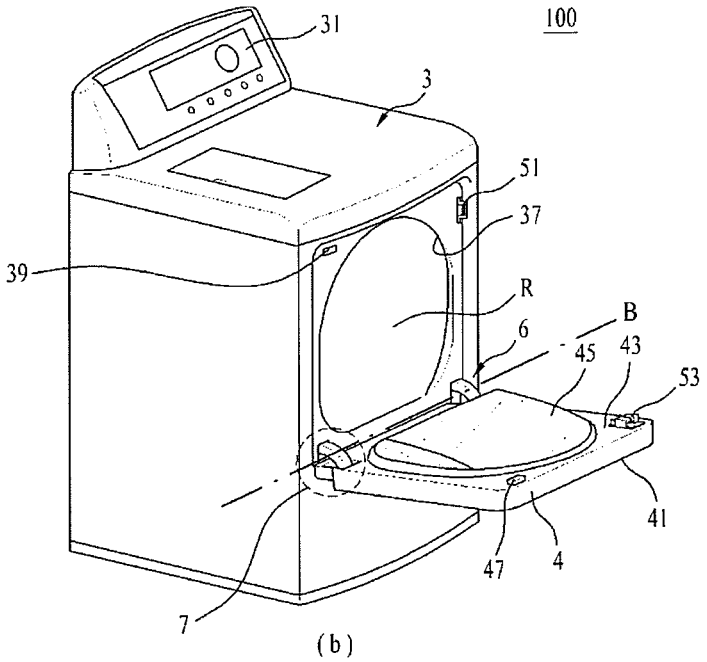

FIG. 37 is a perspective view illustrating a laundry treating apparatus according to a still further embodiment The laundry treating apparatus 100 according to the embodiment may include a cabinet 3 having a laundry accommodating room (R) and a laundry introduction opening 37 configured to introduce the laundry into the laundry accommodating room, a door 4 configured to open and close the opening 37 and a hinge unit 5, 6 and 7 configured to enable the door to rotate the opening along different directions.

The cabinet 3 may define a profile of the laundry treating apparatus and the laundry introduction opening 37 may be provided through an outer panel 33 provided in a side of the cabinet to communicate with the laundry accommodating room (R).

A locking projection receiving part 39 may be provided in the outer panel 33 to receive a locking projection 47 provided in the door 4. The locking projection 47 of the door 4 may be received in the locking projection receiving part 39 provided in the cabinet, such that the door 4 may open and close the laundry introduction opening.

In the meanwhile, a control panel 31 may be provided on the cabinet 3 to enable a user to input a control command to the laundry treating apparatus.

The hinge unit 5, 6 and 7 may form a first pivot (A) to rotate the door to open and close the opening 37 and a second pivot (B) to rotate the door 4 to open and close the opening 37 along a different direction from a direction of the first pivot (A).

The first pivot may be formed by a first hinge 5 and a second hinge 6. The second pivot may be formed by the second hinge 6 and a third hinge 7.

In FIG. 37, the first pivot (A) may be formed along a longitudinal direction of the cabinet 3 (A vertical pivot) and the second pivot (B) may be formed along a width direction of the cabinet (A horizontal pivot). However, the location of the first pivot and the location of the second pivot may not be limited to what shown in FIG. 37 necessarily.

In other words, the first pivot and the second pivot may be located at various positions of the cabinet only if they enable the door to be rotated in various directions to open the opening (only if the first pivot and the second pivot form a preset angle).

Here, as shown in FIG. 37 (*b*), the second pivot may be provided along the width direction of the cabinet to enable the door to be tilted with respect to a lower end of the opening 37. In this case, there may be an effect of efficient laundry loading caused by adjusting a tilting angle of the door, which will be described later.

The door 4 may include an inner frame 43 provided toward the outer panel 33 and an outer frame 41 coupled to the inner frame to from a profile of the door 4.

The door may further include a transparent part 45 insertedly provided in the opening 37. The transparent part 45 may prevent the laundry located in the laundry accommodating room (R) from coming out through the laundry introduction opening and it may also allow the user to see the laundry accommodating room (R) during the operation of the laundry treating apparatus.

As follows, the coupling structure between the hinge unit and the door according to this embodiment will be described in detail in reference to FIG. 38.

Figure 38:
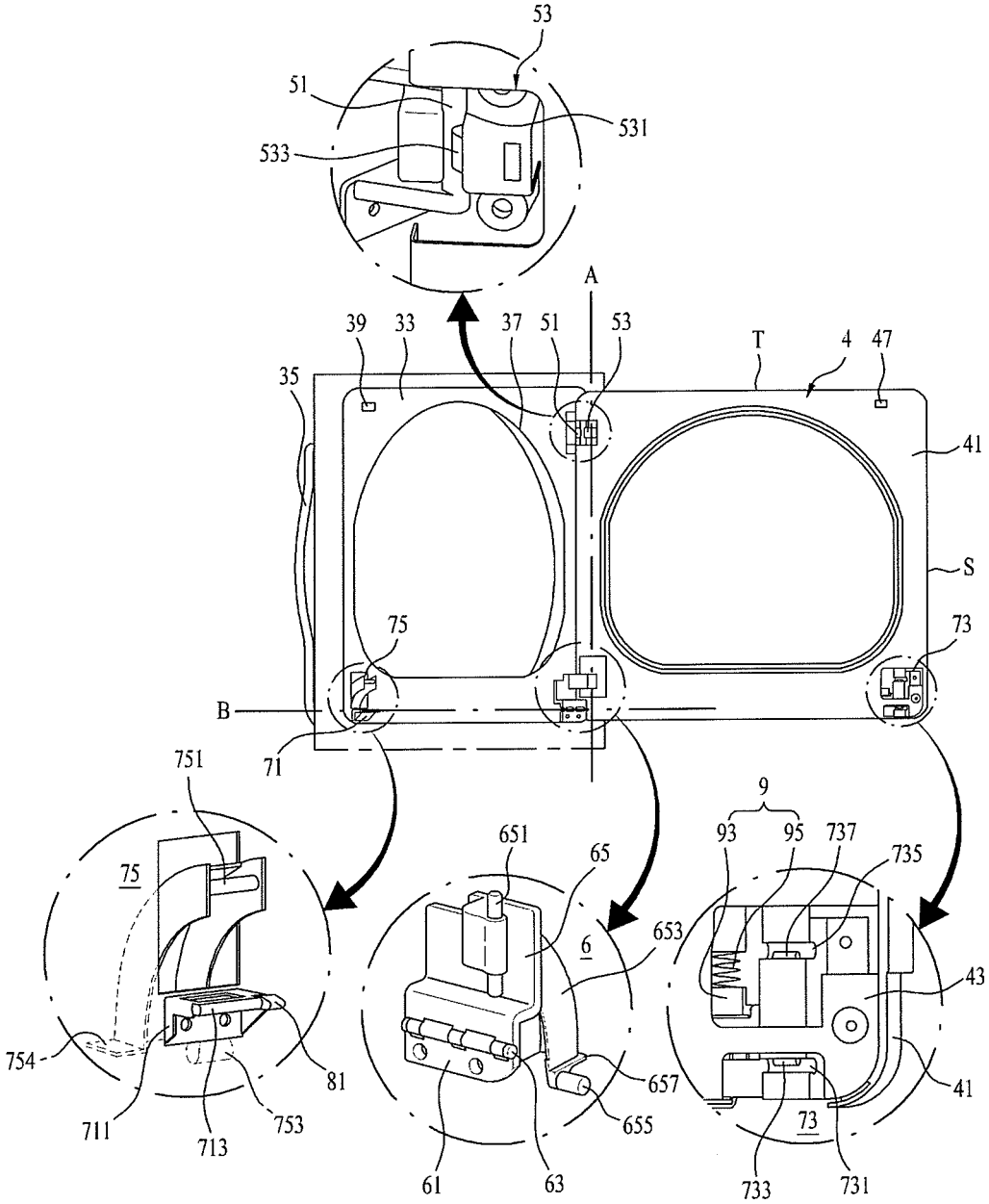
FIG. 38 is a diagram illustrating a door and a hinge unit provided in the laundry treating apparatus according to the embodiment shown in FIG. 41.

The inner frame 43 and the transparent part 45 are omitted from the door shown in FIG. 38 for the description of the coupling structure between the hinge unit and the door.

The hinge unit may include a first hinge 5 having a first shaft consisting of a first pivot (A) to couple and detach the door to and from the cabinet 3, a second hinge 6 having a second shaft consisting of the first pivot (A) together with the first shaft and a third shaft consisting of a second pivot (B), and a third hinge 7 having a fourth shaft consisting of the second pivot (B) together with the third shaft to couple and detach the door 4 to and from the cabinet 3.

In other words, the second hinge 6 may be secured to the cabinet and the door. The first hinge 5 and the third hinge 7 may selectively couple the door 4 to the cabinet.

As a result, the door 4 may be rotated on the first. pivot (A) based on the user's selecting, to open and close the opening 37 (see FIG. 37 (*a*)) or it may be rotated on the second pivot(B) to open and close the opening (see FIG. 37 (*b*)).

The first hinge 5 may include the first shaft provided in either of the cabinet 3 and the door 4 and a first shaft detaching part 53 provided in the other one of the cabinet and the door, to detach the first shaft there from.

FIG. 38 illustrates the first shaft 51 provided in the outer panel 33 of the cabinet and the ftrst shaft detaching part 53 provided in the door.

The first shaft 51 may be located in a right upper end of the outer panel 33, to form the first pivot (A).

The first shaft detaching part 53 may include a shaft receiving groove 531 to receive the first shaft 51 therein, a groove opening/closing part 533 to open and close the shaft receiving groove, an opening/closing part elastically supporting part 535 to elastically support the groove opening/closing part. The opening/closing part elastically supporting part 535 may be received in the groove opening/closing part 533 in FIG. 39. The first shaft 51 and the first shaft detaching part 53 will be described later in reference to FIG. 39.

The second hinge 6 may include a second shaft 651 provided corresponding to the first shaft of the first hinge 5 to form the first pivot (A) and a third shaft 63 forming the second pivot (B).

In detail, the second hinge 6 may be provided an intersection between the first pivot (A) and the second pivot (B). The second hinge 6 may include a cabinet securing part 61 secured to the outer panel 33 and a door securing part 65 secured to the door 4, with being rotatably connected to the cabinet securing part 61 via the third shaft 63.

The second shaft 651 may be provided in the door securing part 65 and the door 4 may be rotatably secured the second shaft 651.

As a result, the door 4 may be rotatable on the first pivot (A) formed by the first shaft 51 and the second shaft 651.

In the meanwhile, the door securing part 65 may be connected to the cabinet securing part 61 by the third shaft 63 forming the second pivot (B).

The second hinge 6 may further include a hinge supporter 653 having an end located in the cabinet and the other end connected with the door securing part 65 to be movable forwardly from the cabinet. The hinge supporter 653 may be extended from the door securing part 65 backwardly and downwardly, with forming a gentle curvature.

The hinge supporter 653 may be configured to adjust an opening angle of the door when the door 4 is rotated on the second pivot (B) to open the opening 37 and it may be coupled to a door tilting adjusting part (8, see FIG. 40) which will be described later.

In the meanwhile, the hinge supporter 653 may include a hinge supporter flange 657 to prevent the hinge supporter 653 from separated from the cabinet (the outer panel), when the door 4 is rotated on the second pivot (B).

The third hinge 7 may include a shaft forming part 71 fixed to either of the outer panel 33 and the door and a shaft detaching part 73 provided in other one of them, with the shaft forming part being detachable there from.

FIG. 38 illustrates the shaft forming part provided in the outer panel 33 and the shaft detaching part 73 provided in the door 4. As follows, the structure of the third hinge according to the embodiment will be described.

The shaft forming part 71 may include a body 711 fixed to the outer panel 33 and a fourth shaft 713 projected from the body 711 to form the second pivot (B) together with the third shaft 63.

The shaft detaching part 73 may include a fourth shaft receiving groove 731 located between the outer frame 41 and the inner frame 33 to receive the fourth shaft therein and a fourth shaft supporting projection 733 configured to support the fourth shaft 713 received in the fourth shaft receiving groove 731.

As a result, when the door 4 is rotated on the first pivot (A) toward the outer panel 33, the fourth shaft 713 may be received in the fourth shaft receiving groove 731 and supported by the fourth shaft supporting projection 733 after that.

The laundry treating apparatus having the configuration mentioned above may enable the user to rotate the door 4 on the first pivot (A) or the second pivot (B).

In other words, in the state of the door closing the opening 37, the first shaft 51 of the first hinge may be inserted in the shaft receiving groove 731 provided in the first shaft detaching part and the fourth shaft 713 of the third hinge may be inserted in the fourth shaft receiving groove 731 of the shaft detaching part.

As a result, when the user pulls the lateral surface (S) of the door 4, the fourth shaft 713 may be detached from the shaft detaching part 73 and it may be rotated on the first pivot (A). When the user pulls the top surface (T) of the door 4, the first shaft 51 may be detached from the first shaft detaching part 53 and it may be rotated on the second pivot (B).

In the meanwhile, when the door is rotated on the second pivot (B), the third hinge 7 may further include a door supporter 75 to adjust an opening angle of the door 4.

An end of the door supporter 75 may be located in the cabinet and the other end thereof may be detachably provided in the shaft detaching part 73.

A flange 754 may be provided at the end of the door supporter located in the cabinet, to prevent the door supporter from separated from the cabinet (the outer panel) when the door is rotated on the second pivot (B). A detaching shaft 751 may be provided in the door supporter to be detachable from the shaft detaching part 73.

In this case, the shaft detaching part 73 may further include a detaching shaft receiving groove 735 to receive the detaching shaft 751 and a detaching shaft supporting projection 737 to support the detaching shaft 751 received in the detaching shaft receiving groove.

Moreover, the shaft detaching part 73 may further include a supporting projection elastically supporting part (739, see FIG. 40) to elastically support the fourth shaft supporting projection 733 and the detaching shaft supporting projection 737.

The door supporter 75 and the hinge supporter 653 may enable the door tilting adjusting part 8 provided in the cabinet 3 to control the opening angle of the door 4, when the door 4 is rotated on the second pivot.

Adjusting the opening angle of the door when the door 4 is rotated on the second pivot (B) may realize an effect of smoothly loading the laundry into the laundry treating apparatus 100 which is configured to dry laundry.

The laundry treating apparatus 100 according to this embodiment is installed adjacent to the laundry treating apparatus only for washing will be described.

It will be very efficient to load the laundry into the laundry accommodating room (R), if the door is opened 30 to 60 degrees on the second pivot (B) when the user is moving the washed laundry to dry to the laundry treating apparatus according to the embodiment.

Especially, if the laundry treating apparatus only for washing is a top loading type capable of loading or unloading laundry via a top thereof, the effect mentioned above may be maximized.

A supporter projection 753 and a hinge supporter projection 655 detachable from the door tilting adjusting part 8 may be provided in the door supporter 75 and the hinge supporter 653, respectively, to be coupled to the door tilting adjusting part 8 to enable the door tilting adjusting part 8 to adjust the opening angle of the door.

Figure 39:
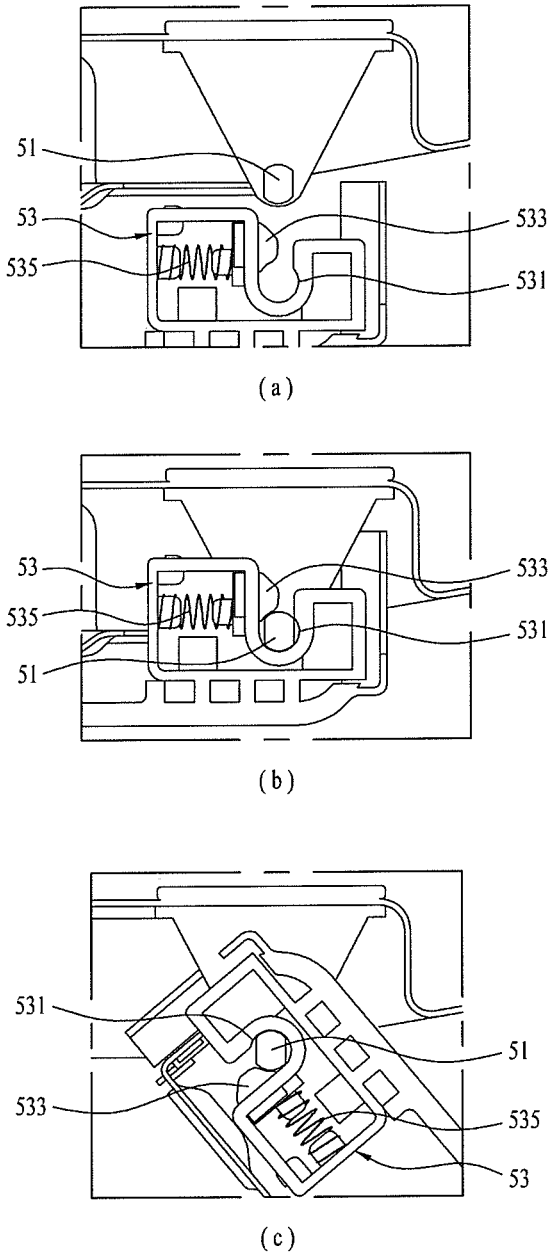
FIG. 39 is a diagram illustrating the motion of a first hinge according to the embodiment.

FIG. 39 illustrates the motion of the first hinge applied to the embodiment. As follows, the motion of the first hinge will be described in reference to FIG. 39.

In FIG. 39 (*a*), the door 4 is rotated on the second pivot (B), Because of that, the first shaft 51 may not be received in the shaft receiving groove 531 and it may he located outside the shaft receiving groove 531, not in the shaft receiving groove 531.

The first shaft 51 may be a D-cut circular-section pole. Here, the D-cut circular section pole means that a cut-surface is provided in each of opposite ends of an outer circumferential surface of the first shaft or an end of the outer circumferential surface.

FIG. 39 (*b*) illustrates that the door 4 doses the opening 37 airtight and the first shaft 51 may he received, in the shaft receiving groove 531.

When the first shaft 51 is received in the shaft receiving groove 531 in the state shown in FIG. 39 (*a*), the cut-surface of the first shaft 51 may press the opening/closing part elastically supporting part 535 of the groove opening/closing part 533. In other words, while the first shaft is getting inserted in the shaft receiving groove 531, the opening/closing part elastically supporting part 535 may be compressed. Once the first shaft 51 is completely inserted in the shaft receiving groove 531, the opening/closing part elastically supporting part 535 may be restituted and the first shaft 51 may he stopped from being separated from the shaft receiving groove 531 by a predetermined force as shown in FIG. 39 (*b*).

In other words, when the door is rotated to close the opening 37 in the state of opening the opening 37 after rotated on the second pivot (B) (see FIG. 37 (*b*) and FIG. 39 (*a*)), the first shaft detaching part 53 provided in the door may he moved toward the first shaft 51 and the first shaft may be inserted in the shaft receiving groove 531 of the first shaft detaching part, to change the state into the state shown in FIG. 39 (*b*).

In this case, an entrance of the shaft receiving groove 531 where the first shaft is inserted may have a corresponding shape to the shape of the first shaft 51. When the door 4 is rotated on the second pivot (B) to close the opening 37, the first shaft 51 may be inserted in the shaft receiving groove 531. However, when the door is rotated on the first pivot (A) after the first shaft is inserted in the shaft receiving groove, the first shaft 51 may be prevented from separated from the shaft receiving groove 531.

FIG. 39 (*c*) illustrates the door 4 rotated on the first pivot (A).

When the door 4 is rotated on the first pivot (A) in the state of FIG. 39 (*b*), the first shaft 51 installed in the door 4 may not be rotated but maintain the state. However, the first shaft detaching part 53 may be rotated along the door 4 and the first shaft 51 may be rotated a predetermined angle within the shaft receiving groove 531 accordingly, At this time, the opening/closing part elastically supporting part 535 may elastically support the groove opening/closing part 533. Because of that, the first shaft 51 may be rotated within the shaft receiving groove 531, without being separated from the shaft receiving groove 531.

In other words, when the door 4 is rotated on the second pivot (B), the first hinge 5 may be in the state shown in FIG. 39 (*a*). When the door 4 closes the opening 37, it may be changed into the state shown in FIG. 39 (*b*). When the door 4 is rotated on the first pivot (A), it may be changed into the state shown in FIG. 39 (*c*).

As follows, the specific structure of the door tilting adjusting part 8 will be described reference to FIG. 40.

Figure 40:
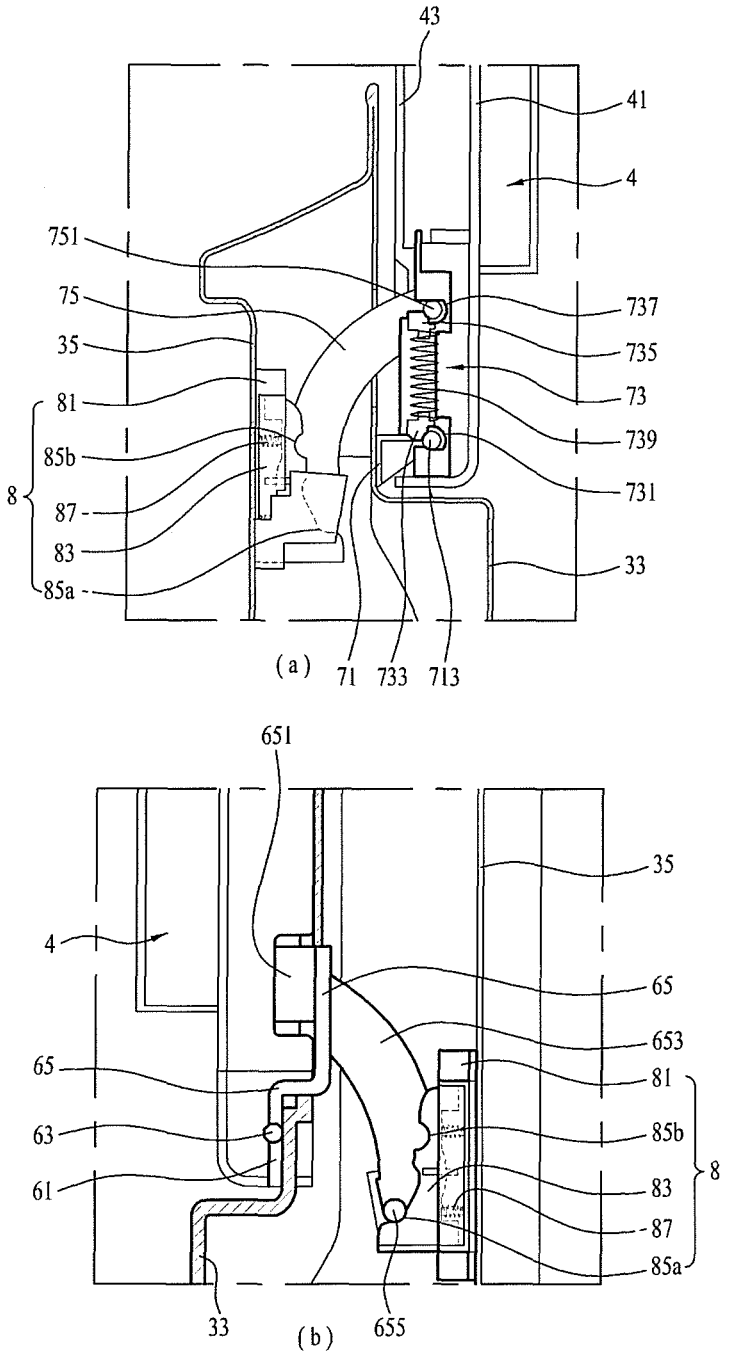
FIGS. 40 to 42 are diagrams illustrating movement of second and third hinges consisting of a hinge part.

FIG. 40 illustrates that the door supporter 75 includes a door tilting adjusting part having the door supporter 75 detachable there from and a door tilting adjusting part having the hinge supporter 653 detachable there from (two door tilting adjusting parts). Alternatively, one of the door tilting adjusting parts 8 may be provided to be detachable from the door supporter 75 or the hinge supporter 653.

For explanation convenience, when describing the structures of the door tilting adjusting part having the door supporter detachable there from and the door tilting adjusting part having the hinge supporter 653 detachable there from, the structure of the door tilting adjusting part haying the hinge supporter 653 detachable there from as shown in FIG. 40 (*b*) will be described. In other words, the door tilting adjusting part 8 applied to the hinge supporter 653 may be identically applied to the door tilting adjusting part 8 applied to the door supporter 75.

The door tilting adjusting part 8 may be located in the cabinet 3, with being fixed to the inner panel 35 provided behind the outer panel 33.

In this case, the door tilting adjusting part 8 may include a fixing body 81 fixed to the inner panel 35, a detaching body 83 movably provided in the fixing body 81 and a projection receiving groove 85*a* and 85*b* provided in the detaching body to receive the hinge supporter projection 655.

A plurality of projection receiving grooves 85*a* and 85*b* may be provided in the detaching body 83, spaced apart a predetermined distance from each other.

One of the projection receiving grooves and another one of them may be spaced apart a predetermined distance from each other, to realize a preset opening angle when the hinge supporter projection 655 is received in the projection receiving grooves.

Figure 44:
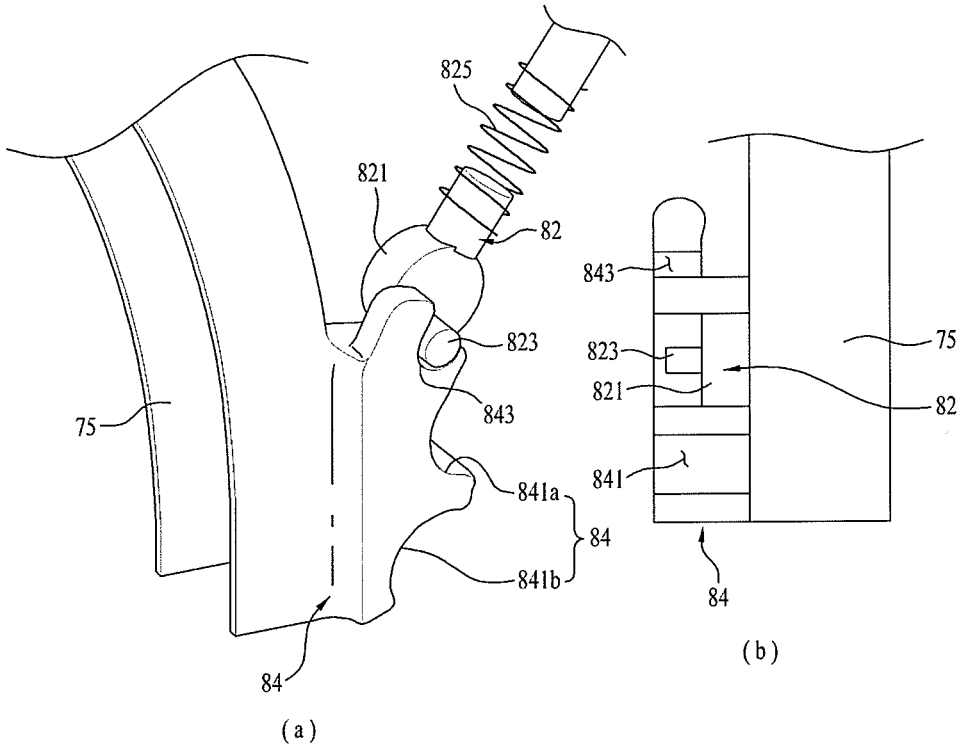
FIG. 44 is a diagram illustrating another embodiment of a door slope adjusting part provided in the laundry treating apparatus according to the embodiment.

FIG. 44 (*b*) illustrates that a projection receiving groove 85*a* receiving the hinge supporter projection 655 when the door is closed and another projection receiving groove 85*b* receiving the hinge supporter projection 655 when an opening angle of the door is approximately 30 or 60 degrees.

In the meanwhile, the detaching body 83 may be supported by the elastically supporting part 87 with respect to the fixing body 81. This is for the hinge supporter projection 655 to be detachable from the detaching body 83 smoothly.

As follows, the motion of the door supporter 75, the hinge supporter 653 and the door tilting adjusting part 8 will be described, when the door 4 is rotated on the second pivot (B) in the laundry treating apparatus having the door tilting adjusting part 8.

Figure 41:
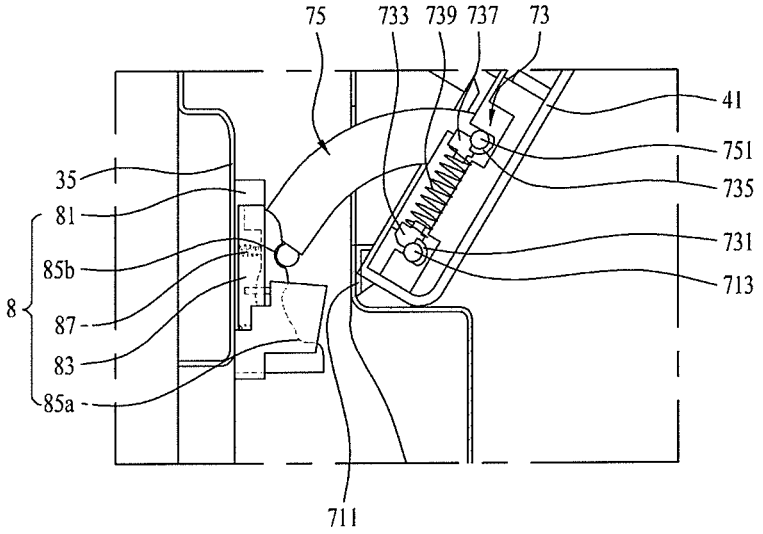
Figure 41:
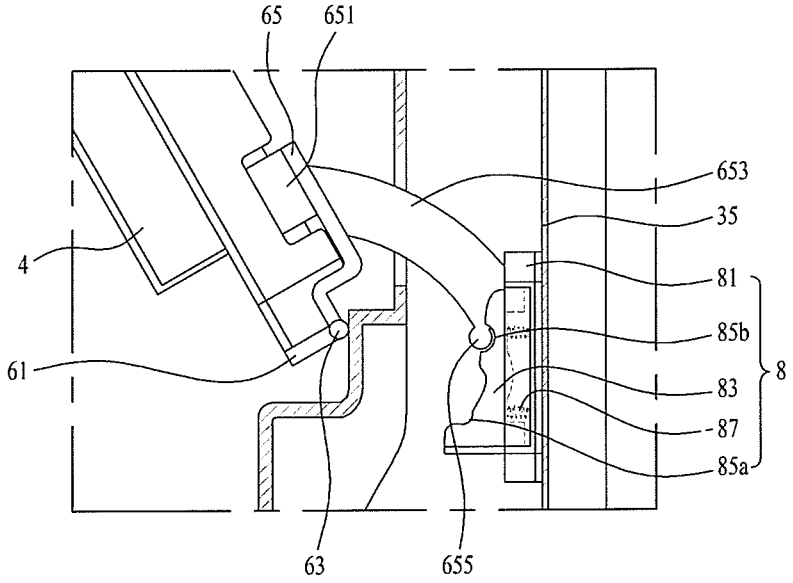
Figure 42:
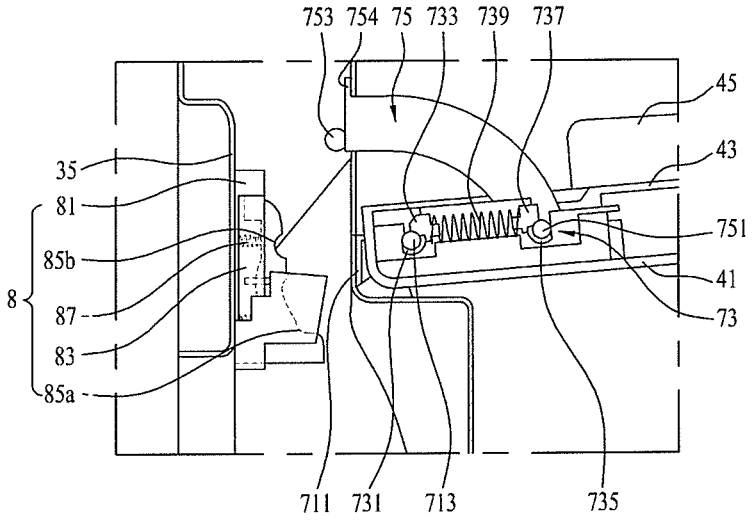
Figure 42:
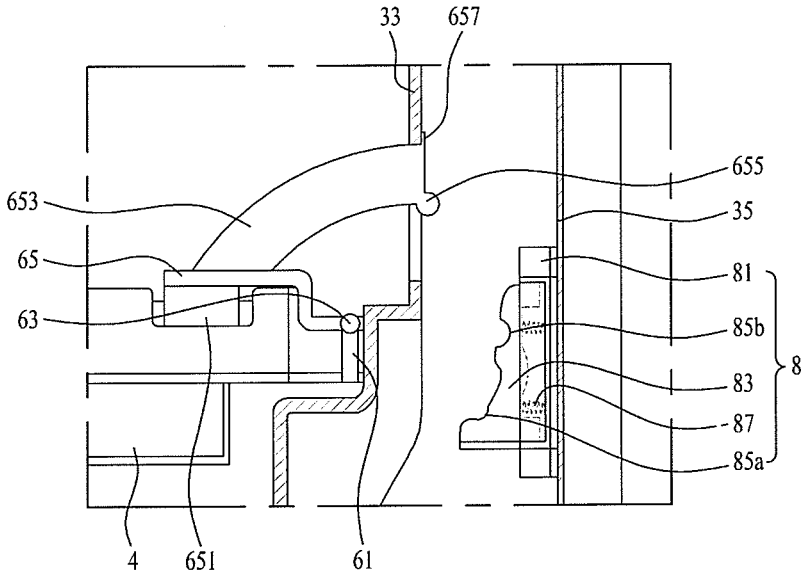

First of all, in reference to FIGS. 40 (*a*), 41 (*a*) and 42 (*a*), the motion of the third hinge 7 and the door tilting adjusting part 8 described. In FIG. 40 (*a*), the door 4 may be perpendicularly secured in the state of closing the opening 37. In FIG. 41 (*a*), the door 4 may be rotated approximately 30 degrees on the second pivot (B). In FIG. 42 (*a*), the door 4 is rotated approximately 85 degrees on the second pivot (B).

As mentioned above, the door tilting adjusting part 8 may be applied only to the hinge supporter 653, not to the door supporter 75. However, the structure applying the door tilting adjusting part 8 even to the door supporter 75 will be described in FIGS. 40 (*a*), 41 (*a*) and 42 (*a*).

When the door 4 closes the opening 37 as shown in FIG. 40 (*a*), the fourth shaft 713 of the third hinge and the detaching shaft 751 of the door supporter may be received in the fourth shaft receiving groove 731 and the detaching shaft receiving groove 735, respectively. The elastic force may be provided to the fourth shaft supporting projection 733 and the detaching shaft supporting projection 737 by the supporting projection elastically supporting part 739 and the fourth shaft supporting projection 733 and the detaching shaft supporting projection may support the fourth shaft and the detaching shaft, respectively.

Also, the supporter projection 753 of the door supporter 75 may be received in the projection receiving groove 85*a* of the door tilting adjusting part 8.

At this time, when the user pulls the top surface (T, see. FIG. 38) of the door, the door 4 may be rotated on the fourth shaft 713 forming the second pivot and the end of the door supporter 75 fixed to the shaft detaching part 73 may be rotated.

When the end of the door supporter 75 is rotated approximately 30 degrees, the supporter projection 753 may be seated in the projection receiving groove 85*b* provided in the detaching body, as moving along the detaching body of the door tilting adjusting part 8 (the state shown in FIG. 41). In other words, the supporter projection 753 may be fixed to the projection receiving groove 85*b* and the rotation of the door 4 may be then stopped.

Hence, when the user rotates the door 4 a larger angle, in other words, when he or she applies a predetermined force enough to detach the supporter projection 753 from the projection receiving groove 85*b*, the supporter projection 753 may be detached from the projection receiving groove 85*b* and the door 4 may be rotated. Once the door supporter 75 is detached from the door tilting adjusting part 8 to open the door completely, the flange 754 provided in the door supporter may contact with the rear surface of the outer panel 33, to support the door 4 (the state shown in FIG. 42 (*a*)).

In other words, when the user rotates the door on the second pivot (B), the supporter projection 753 may be received in or detached from the projection receiving grooves 85*a* and 85*b* sequentially, to fix the rotational angle of the door 4.

In reference to FIGS. 40 (*b*), 41 (*b*) and 42 (*b*), the motion of the second hinge 6 and the door tilting adjusting part 8 will be described. In FIG. 40 (*b*), the door 4 may be perpendicularly secured the state of closing the opening 37. In FIG. 40 (*b*), the door 4 may be rotated approximately 30 degrees on the second pivot (B), In FIG. 42 (*b*), the door 4 may be rotated approximately 85 degrees on the second pivot (B).

When the door 4 closes the opening 37, the hinge supporter projection 655 may maintain the state of being received in the projection receiving groove 85*a* of the door tilting adjusting part 8 (the state shown in FIG. 40 (*b*)).

When the user pulls the top (T) of the door, the door 4 may be rotated on the third shaft 63 forming the Second pivot (B). When the door 4 is rotated, the hinge supporter projection 655 of the hinge supporter 653 may be detached from the projection receiving groove 85*a* and it may he moved toward the outer panel 33 accordingly. After that, the hinge supporter projection 655 may be seated in the projection receiving groove 85*b* (the state shown in FIG. 41 (*b*)), At this time, if other ones are thrilled rather than the projection receiving groove 85*b*, the rotated angle of the door 4 may be fixed at various angles, rather than approximately 30 degrees.

When the user rotates the door 4 a larger angle, that is, when the user applies a predetermined force enough to detach the hinge supporter projection 655 from the projection receiving groove 85*b*, the hinge supporter projection 655 may be detached from the projection receiving groove 85*b* and the door 4 may be rotated. Once the hinge supporter 653 is detached from the door tilting adjusting part 8 to open the door completely, the supporter flange 657 provided in the door supporter may contact with the rear surface of the outer panel 33, to support the door 4 (the state shown in FIG. 42 (*b* )).

In other words, when the user rotates the door 4 on the second pivot (B), the hinge supporter projection 655 may be received in or detached from the projection receiving grooves 85*a* and 85*b* sequentially and the rotation angle of the door 4 may be fixed.

Moreover, the laundry treating apparatus according to the embodiment may further include a supporter elastically supporting part to supplement the door supporting force of the flanges 657 and 754 provided in the supporters 653 and 75, respectively, when the door 4 is open completely.

Figure 43:
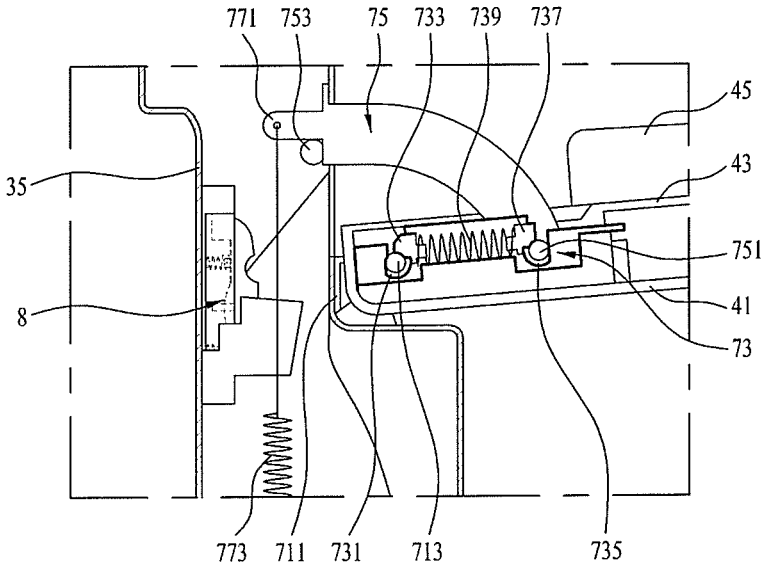
FIG. 43 is a diagram illustrating another embodiment of the second and third hinges.

FIG. 43 illustrates only the supporter elastically supporting part provided in the door supporter 75 and the supporter elastically supporting part may be provided in each of the door supporter and the hinge supporter. As follows, the supporter elastically supporting part 771 and 773 provided in the door supporter will be described for explanation convenience.

The supporter elastically supporting part may include an elastic part 773 to provide a restitution force to the door supporter 75 toward the inside of the cabinet when the door supporter 75 is detached out of the outer panel 33.

In this case, a rib 771 may be further provided at an end of the door supporter 75 to couple the elastic part 773 thereto. This is to prevent the elastic part 773 from interfering with other devices provided in the door, which might be generated when the elastic part 773 is directly coupled to the door supporter 75.

In the meanwhile, the door tilting adjusting part may be variable in variable ways and FIG. 44 illustrates another embodiment of the door tilting adjusting part.

The door tilting adjusting part according to this embodiment may include a fixing part 82 located in the cabinet and a fixing part receiving groove 84 provided in the door supporter 75 to receive the fixing part 82.

The fixing part 82 may include a first fixing projection 821 having a predetermined diameter and a second fixing projection 823 projected from the first fixing projection, having a smaller diameter than the diameter of the first fixing projection.

Also, the first fixing projection 821 may be supported by the elastically supporting part 825 provided in a space formed between the outer panel 13 and the inner panel 15 of the cabinet 1.

The fixing part receiving groove 84 may include a first projection receiving groove 84 to receive the first fixing projection 821 and a second projection receiving groove 843 to receive the second fixing projection 821.

The second projection receiving groove 843 may be configured to receive only the second fixing projection 823 and the first projection receiving groove 841 may be configured to receive only an outer circumferential surface of the first fixing projection 821.

Also, at least 42 first projection receiving grooves 841 may be provided and one of them may be spaced apart a predetermined distance from another one.

The fixing part receiving groove 84 shown in FIG. 44 may include a second projection receiving groove 843 to support the door supporter when the opening is closed by the door, a first projection receiving groove 841*a* to support the door supporter when the door is opened 30 degrees on the second pivot, and a first projection receiving groove 841*b* to support the door supporter when the door 4 is opened 90 degrees on the second pivot (B).

The reason why the diameter of the second projection 823 is smaller than that of the first projection 821 is that it is difficult to form a groove capable of supporting the weight of the door in a gap between the second projection receiving groove 843 and the first projection receiving groove 841*a*, when the opening angle of the door is controlled only by the first projection 821.

FIG. 44 illustrates that the axing part receiving groove 84 is provided only in the door supporter 75. However, in the door tilting adjusting part mentioned above, the fixing part receiving groove 84 may be provided in the hinge supporter 653 and the fixing part 82 may be detachable from the fixing part receiving groove provided in the hinge supporter.

In the laundry treating apparatus having the configuration mentioned above, the door 4 rotated on the second pivot may be supported by the flanges 754 and 657 provided in the door supporter and the hinge supporter, respectively. However, there might be danger of the detaching shaft 751 of the door supporter being separated from the shaft detaching part 73 because of the weight of the door.

As a result, the laundry treating apparatus according to the embodiment may further include a door fixing part to prevent the separation of the shaft detaching part 73 and the detaching shaft 751 of the door supporter. As follows, the door fixing part 9 will be described in reference to FIG. 45.

The door fixing part 9 may include a supporter coupling projection 93 located in the door 4, being movable to be fixed to the door supporter when the door is rotated on the second pivot.

At this time, a coupling projection seating part 755 may be provided in the door supporter 75 to seat the supporter coupling projection 93 thereon. The coupling projection seating part 755 may be projected from the door supporter 75, to be seated on the coupling projection seating part 755 in contact when the door is rotated.

In the meanwhile, the motion of the supporter coupling projection 93 may be enabled by a cam 91 provided in the shaft forming part 71 of the third hinge and the coupling projection elastically supporting part 95 provided in the door 4 to elastically support the supporter coupling projection 93.

In other words, the supporter coupling projection 93 may he provided adjacent to the shaft detaching part 73 and it may be supported by the elastically supporting part 95 (see FIG. 39). The cam 91 may be located outer to the fourth shaft receiving groove 731 provided in the shaft detaching part 73 and it may be located lower than the supporter coupling projection 93, when the door 4 is closed.

Also, the cam 91 may be formed in a shape enabling the supporter coupling projection 93 to move toward the door supporter 75, when the door 4 is rotated on the second pivot. At this time, the cam 91 may not be rotated but fixedly extended along a horizontal direction.

Figure 45:
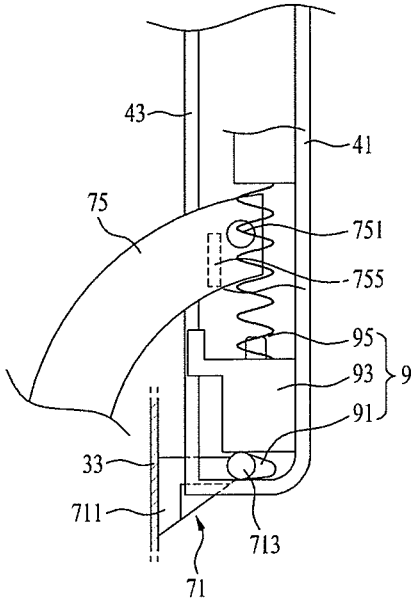
FIG. 45 is a conceptual diagram illustrating a door securing part provided in the laundry treating apparatus according to the embodiment of FIG. 41 to prevent downward movement of the door.
Figure 45:
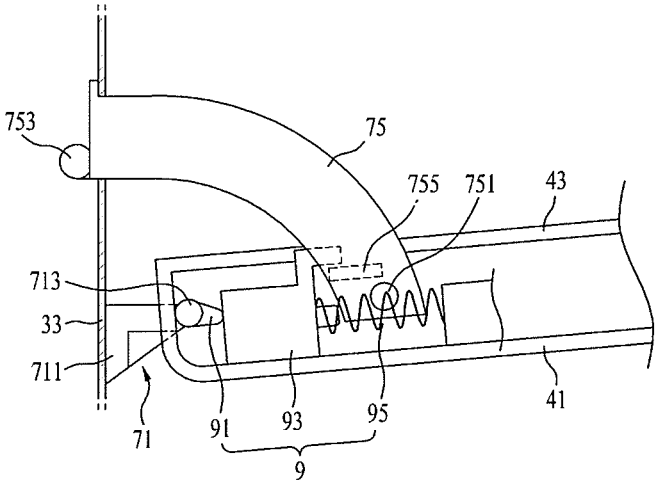

When the door fixing part 9 includes the configuration mentioned above, the door 4 may be rotated on he second pivot (B) and the supporter coupling projection 93 may be moved along an outer circumferential surface of the cam 91 within the door 4 almost horizontally as shown in FIG. 45 (*b*). As a result, as the elastically supporting part 95 is pressed, the supporter coupling projection 93 may be moved toward the door supporter 75.

When the door is opened completely, the supporter coupling projection 93 may contact with the coupling projection seating part 755 provided in the door supporter and it may be stopped. As a result, the supporter coupling projection 93 may prevent the door 4 from being rotated a larger angle.

Also, even when the door 4 is rotated on the second pivot (B) only to open the opening 37 completely, the laundry treating apparatus may prevent the separation of the shaft detaching part 73 provided in the door and the detaching shaft 751 provided in the door supporter. This is because the door 4 might be separated from the laundry treating apparatus, when the door 4 is rotated a larger angle.

In the meanwhile, when the door 4 is rotated on the second pivot (B) to close the opening 37, the supporter coupling projection 93 may be moved within the door by the elastically supporting part 95, with maintaining the contact with the outer circumferential surface of the earn. At this time, the external force applied by the outer circumferential surface of the cam 91 may be eliminated from the elastically supporting part 95. Because of that, the elastically supporting part 95 may be restituted by the restitution force, without compressed. As a result, the supporter coupling projection 93 may be detached from the coupling projection seating part 755 and it may he changed as shown in FIG. 45 (*a*).

The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure.

According to the embodiments, the laundry treating apparatus can provide convenience to the user by enabling a door open and closed along a vertical or horizontal direction selectively.

Furthermore, the laundry treating apparatus can open the door stably, because the door is not open along the other rotational direction, when the user rotates the door along a selected rotational direction.

Still further, the laundry treating apparatus can reduce installation spatial limitation of securing a space for opening the door horizontally when the laundry treating apparatus is used, because the door provided in the laundry treating apparatus can be open along vertically not horizontally.

Still further, the laundry treating apparatus enables laundry to be loaded into an accommodating room via the opening smoothly after colliding against a surface of the door, when laundry is loaded via the opening.

Any reference in this specification to "one embodiment," "an embodiment," "example embodiment," etc., means that a particular feature, structure, or characteristic described in connection with the embodiment is included in at least one embodiment of the invention. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry apparatus, comprising:

a first cabinet;

a first space provided in the first cabinet and configured to provide a space to receive laundry;

a first opening provided on a top surface of the first cabinet that communicates with the first space;

a second cabinet provided separate from the first cabinet;

a second space provided in the second cabinet and configured to provide a space to receive laundry;

a second opening provided in a front surface of the second cabinet that communicates with the second space;

a door that opens and closes the second opening; and a hinge including:

a first axis located under the second opening, wherein the door is rotated in a first direction on the first axis, and wherein the first axis extends parallel to a bottom surface of the second cabinet; and a second axis on which the door is rotated in a second direction which is different from the first direction, wherein the hinge supports the door so that the door maintains a first position and a second position when the door is rotated on the first axis, wherein an angle between the door and the second opening in the first position is 0 degree, wherein the angel between the door and the second opening in the second position is greater than 0 degree and less than 90 degrees, and wherein, in the second position, an inner surface of the door forms a tilted slope to guide the laundry placed on the inner surface into the second opening due to gravity.

2. The laundry apparatus of claim 1, wherein the hinge further includes:

a first hinge having a first shaft that detachably secures the door to the second cabinet and forms the first axis;

a second hinge having a first body fixed to the second cabinet, a second body having a second shaft that forms the first axis, and a third shaft that rotatably secures the second body to the first body and forms the second axis; and a third hinge having a fourth shaft that detachably secures the door to the second cabinet and forms the second axis.

3. The laundry apparatus of claim 2, wherein the first hinge, the second hinge, and the third hinge are provided on the front surface of the second cabinet.

4. The laundry apparatus of claim 3, wherein the front surface of the second cabinet includes a stepped portion adjacent the second opening of the second cabinet, and wherein the first hinge, the second hinge, and the third hinge are provided on the stepped portion.

5. The laundry, apparatus of claim 4, wherein a guide plate is formed in the stepped portion of the front surface of the second cabinet, and wherein the first hinge, the second hinge, and the third hinge are provided on the guide plate.

6. The laundry apparatus of claim 1, wherein the first space is a washing space for the laundry, and the second space is a drying space for the laundry.

7. The laundry apparatus of claim 6, wherein the first space includes an outer tub provided in the first cabinet to store water, and an inner tub provided in the outer tub and rotatable on an axis perpendicular to a bottom surface of the first cabinet, and wherein the second space includes a drum rotatably provided in the second cabinet.

8. The laundry apparatus of claim 7, wherein the drum is rotatable on an axis which is horizontal to a bottom surface of the second cabinet.

9. The laundry apparatus of claim 1, wherein the door includes at least one hooking projection, wherein the second cabinet includes at least one hooking groove, and wherein when the door maintains the first position, the at least one hooking projection is detachably inserted into the at least one hooking groove.

10. The laundry apparatus of claim 9, wherein the at least one hooking projection projects from an inner surface of the door, wherein the at least one hooking groove is formed in the front surface of the second cabinet, and wherein when the at least one hooking projection is detachably inserted into the at least one hooking groove, the door closes the second opening of the second cabinet.

11. The laundry apparatus of claim 10, wherein the front surface of the second cabinet includes a stepped portion adjacent the second opening of the second cabinet.

12. The laundry apparatus of claim 11, wherein a guide plate is formed in the stepped portion of the front surface, and wherein when the door closes the second opening, the guide plate is in close contact with the inner surface of the door.

13. The laundry apparatus of claim 12, wherein the at least one hooking groove is formed in the guide plate.

14. A laundry apparatus, comprising:

a cabinet;

a first space provided in the cabinet and configured to provide a space to receive laundry;

a first opening provided on a top surface of the cabinet that communicates with the first space;

a second space which is provided in the cabinet to provide a space to receive laundry and separate from the first space;

a second opening provided on a front surface of the cabinet that communicates with the second space;

a door that opens and closes the second opening; and a hinge including:

a first axis located under the second opening, wherein the door is rotated in a first direction on the first axis, and wherein the first axis extends parallel to a bottom surface of the cabinet; and a second axis on which the door is rotated in a second direction that is different from the first direction, wherein the hinge supports the door so that the door maintains a first position and a second position when the door is rotated on the first axis, wherein an angle between the door and the second opening in the first position is 0 degree, wherein the angle between the door and the second opening in the second position is greater than 0 degree and less the than 90 degrees, and wherein, in the second position, an inner surface of the doors forms a tilted slope to guide the laundry placed on the inner surface into the second opening due to gravity.

15. The laundry apparatus of claim 14, wherein the hinge further includes a first hinge, a second hinge, and a third hinge provided on the front surface of the cabinet.

16. The laundry apparatus of claim 15, wherein the front surface of the cabinet includes a stepped portion adjacent the second opening of the cabinet, and wherein the first hinge, the second hinge, and the third hinge are provided on the stepped portion.

17. The laundry apparatus of claim 16, wherein a guide plate is formed in the stepped portion of the front surface of the cabinet, and wherein the first hinge, the second hinge, and the third hinge are provided on the guide plate.

18. The laundry apparatus of claim 14, wherein the front surface of the cabinet includes at least one hooking groove, and wherein the door includes at least one hooking projection that is detachably hooked into the at least one hooking groove when the door maintains the first position.

* * * * *